US008714132B2

(12) United States Patent
Baumann et al.

(10) Patent No.: US 8,714,132 B2
(45) Date of Patent: May 6, 2014

(54) SEPARATOR FOR SEPARATING OIL MIST FROM THE CRANKCASE VENTILATION GAS OF AN INTERNAL COMBUSTION ENGINE, AND FUNCTIONAL MODULE AND INTERNAL COMBUSTION ENGINE COMPRISING A SEPARATOR

(75) Inventors: Dieter Baumann, Greven (DE); Christian Vinkelau, Rosendahl-Osterwick (DE); Guido Schlamann, Münster (DE)

(73) Assignee: Hengst GmbH & Co. KG, Muenster (DE)

( * ) Notice: Subject to any disclaimer, the term of this patent is extended or adjusted under 35 U.S.C. 154(b) by 1128 days.

(21) Appl. No.: 12/668,772

(22) PCT Filed: Jul. 11, 2008

(86) PCT No.: PCT/EP2008/005702

§ 371 (c)(1),
(2), (4) Date: Jan. 12, 2010

(87) PCT Pub. No.: WO2009/010248

PCT Pub. Date: Jan. 22, 2009

(65) Prior Publication Data

US 2010/0180854 A1 Jul. 22, 2010

(30) Foreign Application Priority Data

Jul. 13, 2007 (DE) ..... 20 2007 009 913 U
Nov. 15, 2007 (DE) ..... 10 2007 054 922

(51) Int. Cl.
*F01M 11/03* (2006.01)

(52) U.S. Cl.
USPC ..... 123/196 A

(58) Field of Classification Search
USPC ..... 123/196 A
See application file for complete search history.

(56) References Cited

U.S. PATENT DOCUMENTS 4,284,504 A * 8/1981 Alexander et al. ..... 210/167.04
5,466,385 A * 11/1995 Rogers et al. ..... 210/787

(Continued)

FOREIGN PATENT DOCUMENTS

DE 4311906 A1 10/1994
DE 202005014232 U1 2/2007

(Continued)

*Primary Examiner* — Lindsay Low
*Assistant Examiner* — Ruben Picon-Feliciano
(74) *Attorney, Agent, or Firm* — Greer, Burns & Crain Ltd.

(57) ABSTRACT

A separator for separating oil mist from the crankcase ventilation gas of an internal combustion engine, especially of a motor vehicle. The separator includes a gas purification chamber inside which a rotatably mounted centrifugal rotor is arranged. The gas purification chamber has a crude gas inlet, a pure gas outlet, and an oil outlet. The crankcase ventilation gas can be conducted into a radially internal zone of the centrifugal rotor via the crude gas inlet, while pure gas that is liberated from oil mist can be discharged from the gas purification chamber via the pure gas outlet, and oil separated from the gas can be discharged from the gas purification chamber via the oil outlet. The separator further includes a rotary drive for the centrifugal rotor. The rotary drive is disposed in a drive chamber of the separator, can be operated using pressurized lubrication oil of the internal combustion engine, and is connected to the centrifugal rotor by means of a shaft extending from the drive chamber into the gas purification chamber, from which the drive chamber is separated. The rotary drive is formed by at least one thrust nozzle which is connected to the shaft and to which the pressurized lubrication oil of the internal combustion engine can be fed. The separator includes at least one part of a base that forms the separation between the gas purification chamber and the drive chamber and extends into the drive chamber, the part of the base being fitted with a seat for a bearing of the shaft. The bearing is located at a distance from the centrifugal rotor.

29 Claims, 25 Drawing Sheets

(56) References Cited

U.S. PATENT DOCUMENTS

| | | | | |
|---|---|---|---|---|
| 6,019,717 | A * | 2/2000 | Herman | 494/49 |
| 6,709,477 | B1 | 3/2004 | Hakansson et al. | |
| 6,821,319 | B1 * | 11/2004 | Moberg et al. | 95/270 |
| 7,235,177 | B2 * | 6/2007 | Herman et al. | 210/360.1 |
| 2002/0088445 | A1 | 7/2002 | Weindorf et al. | |
| 2005/0023208 | A1 * | 2/2005 | Carew | 210/352 |
| 2007/0163444 | A1 | 7/2007 | Eliasson | |
| 2008/0296212 | A1 | 12/2008 | Baumann | |

FOREIGN PATENT DOCUMENTS

| | | | | |
|---|---|---|---|---|
| DE | 202005020012 | U1 | 5/2007 | |
| EP | 1217183 | A1 | 6/2002 | |
| WO | 9811332 | | 3/1998 | |
| WO | 9956883 | | 11/1999 | |
| WO | 2004091799 | | 10/2004 | |
| WO | 2005087383 | | 9/2005 | |
| WO | WO 2005087383 | A1 * | 9/2005 | B04B 5/00 |
| WO | WO 2006119890 | A1 * | 11/2006 | B04B 5/00 |
| WO | WO2007073320 | | 6/2007 | |

* cited by examiner

SEPARATOR FOR SEPARATING OIL MIST FROM THE CRANKCASE VENTILATION GAS OF AN INTERNAL COMBUSTION ENGINE, AND FUNCTIONAL MODULE AND INTERNAL COMBUSTION ENGINE COMPRISING A SEPARATOR

BACKGROUND OF THE INVENTION

The invention relates to a separator for separating oil mist from the crankcase ventilation gas of an internal combustion engine, especially of a motor vehicle; with a gas purification chamber inside which a rotatably mounted centrifugal rotor is arranged. The gas purification chamber has a crude gas inlet, a pure gas outlet, and an oil outlet. The crankcase ventilation gas can be conducted into a radially internal zone of the centrifugal rotor via the crude gas inlet, while pure gas liberated from oil mist can be discharged from the gas purification chamber via the pure gas outlet, and oil separated from the gas can be discharged from the gas purification chamber via the oil outlet. The separator comprises a rotary drive for the centrifugal rotor, the rotary drive being arranged in a drive chamber of the separator, the drive chamber being separately arranged from the gas purification chamber, and the drive can be operated using pressurized lubrication oil of the internal combustion engine and is connected to the centrifugal rotor by means of a shaft extending from the drive chamber into the gas purification chamber. The rotary drive is formed by at least one thrust nozzle which is connected to the shaft and to which the pressurized lubrication oil of the internal combustion engine can be fed. The invention furthermore relates to a functional module and an internal combustion engine which are provided with a corresponding separator.

A first separator is known from WO 2004/091 799 A. In this known separator, the rotary drive is formed by an impeller wheel arranged on the shaft onto which pressurized lubrication oil of the internal combustion engine can be sprayed through at least one stationary installed nozzle. It is considered disadvantageous with this known separator that its rotary drive has a relatively bad efficiency so that a large volume of pressurized lubrication oil is consumed to achieve the desired high speed of the centrifugal rotor, said oil then being no longer available for the lubrication of the associated internal combustion engine. It is accordingly required in many cases to provide a higher output oil pump or an additional oil pump for the rotary drive of the separator which results in increased manufacturing costs. If the last-named measures increasing the costs are avoided, the disadvantage is to be accepted that the achievable maximum speed of the centrifugal rotor is limited, due to which the separating performance of the separator also remains limited, and accordingly the task conceived for the separator is not reliably fulfilled, namely de-oiling the crankcase ventilation gas to the farthest extent possible.

Another separator is known from U.S. Pat. No. 6,709,477 B1. With this additionally known separator as well, an impeller wheel arranged on the shaft is provided as rotary drive for the centrifugal rotor and a liquid jet is sprayed onto it, usually pressurized lubrication oil of an associated internal combustion engine. This separator has the same disadvantages as the above described first known separator.

A lubrication oil centrifuge is known from WO 1999/056 883 A for cleaning the lubrication oil of an internal combustion engine, with a separator for separating oil from the crankcase ventilation gas being set onto a rotor of the centrifuge, and the separator can be set to rotate together with the rotor of the centrifuge. The lubrication oil centrifuge is driven by thrust nozzles through which the lubrication oil centrifuged in the rotor of the centrifuge exits into a pressureless chamber surrounding the centrifuge. From this chamber, the lubrication oil flows off, without pressure, through a channel of a correspondingly large cross-section and preferably back into the oil pan of the associated internal combustion engine. The separator set onto the rotor of the centrifuge is here used for de-oiling the crankcase ventilation gas. The crankcase ventilation gas to be liberated from oil mist flows in counterflow to the flowing-off lubrication oil through its return flow channel into the chamber in which the lubrication oil exits from the thrust nozzles. The crankcase ventilation gas flows through this chamber upwardly to the separator above the rotor and arranged on is to be considered disadvantageous in this device that the crankcase ventilation gas is passed through the return flow channel for the lubrication oil and through the chamber in which the lubrication oil exits from the thrust nozzles; and the crankcase ventilation gas is accordingly burdened with a considerable additional oil load which the crankcase ventilation gas entrains on its further way to the separator. An unnecessarily large amount of oil mist or oil droplets must therefore be separated from the crankcase ventilation gas in the separator. As a consequence, the separator must be relatively large in design and thus occupy a large structural space to ensure the necessary separation; or oil portions remain in the crankcase ventilation gas after its passage through the separator. Both specified consequences are undesirable since the aim is always the smallest possible structural space and the highest possible degree of separation. Moreover, the maximum achievable speed of a lubrication oil centrifuge is too low for good oil mist separation which results in a bad efficiency of a separator combined with a lubrication oil centrifuge.

A separator of the initially indicated type is known from WO 2007/073 320 A. The rotor of this separator is preferably rotatably provided in its own frame which can be set into a housing and fixed therein. This document does not provide any further concrete information regarding the execution of the bearing; however, the presentations of the exemplary embodiment in the drawing FIGS. 2 and 4 show that two bearings of the shaft of the rotor lie relatively closely together in axial direction and that the assembly of the multipart frame in the area of the bearings is complex since several screws are required. This construction moreover shows that the bearing of the rotor is not particularly favorable in design and that particularly desirable high speeds of the rotor are not achievable.

SUMMARY OF THE INVENTION

For the present invention, the objective accordingly is to provide a separator of the initially indicated type which avoids the above presented disadvantages and in which the rotary drive provides—especially with a specified drive power—for a high speed of the centrifugal rotor and thus for a high separating degree of oil mist from the crankcase ventilation gas while production and assembly are to be economical. Furthermore, the objective of the invention is to identify a functional module and an internal combustion engine which are equipped with a corresponding separator.

The first part of the problem, relating to the separator, is successfully solved with a separator of the initially indicated type characterized in that at least one part of a base that forms the separation between the gas purification chamber and the drive chamber extends into the drive chamber, said part of the base being fitted with a seat for a bearing of the shaft, the bearing being located at a distance from the centrifugal rotor.

The invention advantageously achieves a favorable bearing of the rotor, providing low friction and avoiding imbalances.

A high efficiency of the rotary drive is thus achieved which effects a higher speed of the centrifugal rotor with the same consumption of pressurized lubrication oil. The achieved higher speed of the centrifugal rotor provides for a high separation efficiency in terms of the oil mist entrained in the crankcase ventilation gas. Thus, the separator according to the invention makes a largely purified crankcase ventilation gas available at its pure gas outlet which can be introduced, without the risk of damage, into the suction tract of an associated internal combustion engine. Malfunctions of the internal combustion engine are thus prevented which are caused by oil deposits in the suction tract; for example, on the throttle valves or air flow meters there arranged. In particular, a highly space-saving housing of the separator is also achieved. The feature that a base forms the separation between the gas purification chamber and the drive chamber contributes to the separator making do with few individual parts. At first sight, the rotary drive by means of at least one thrust nozzle on the shaft appears to be relatively complex because pressurized lubrication oil must be passed to the or each of the thrust nozzle(s) rotating with the shaft; however, this higher technical expenditure is more than compensated for by the greater efficiency achieved in oil separation from the crankcase ventilation gas. Since, according to the invention, the separator has a rotary drive with a high efficiency, only a relatively small percentage of the pressurized lubrication oil of the associated internal combustion engine is required so that the application of a more powerful or an additional lubrication oil pump is not required. Accordingly, cost-increasing modifications of the associated internal combustion engine are not required for the application of the separator according to the invention.

Another embodiment provides that two bearings bearing the shaft are spaced apart from each other and arranged in the base. Since both bearings are arranged in the same base, precision machining of the base in the areas in which it takes up the bearings is possible in a single clamping which excludes alignment errors in the bearing of the shaft. This ensures exact and smooth-running bearing of the rotatable shaft.

To be able to manufacture the base at a particularly low cost, it is provided that the base including two seats for the bearings of the shaft is executed as a one-piece pressure die cast or injection molded part.

Alternatively, the possibility exists that the base, including two seats for the bearings of the shaft, is executed as a two-piece or multiple pressure die cast or injection molded part, with these two or more parts being connected with each other. This design is particularly expedient when the base is to take over additional functions.

So that the part of the base extending into the drive chamber does not obstruct the discharge of the lubrication oil exiting from the at least one thrust nozzle, the part of the base extending into the drive chamber is preferably designed with one or a plurality of openings for a passage of the lubrication oil exiting from the at least one thrust nozzle. The openings can be designed e.g. in the form of one or a plurality of windows. Alternatively, the part of the base extending into the drive chamber can also be designed as a lattice structure.

The rotary drive is preferably formed by a pair of two thrust nozzles uniformly spaced in circumferential direction. This achieves an introduction of the drive force into the shaft which is uniformly seen in circumferential direction, and thus the lowest possible burden of the shaft and of the bearings bearing the shaft.

Furthermore, it is preferably provided that the thrust nozzles are arranged in a radially exterior area of a nozzle carrier which is essentially conical or has a conical jacket shape. Such a nozzle carrier realizes a particularly streamlined form which provides low resistance in high-speed rotation. In particular, friction of the nozzle carrier is thus minimized on the lubrication oil discharged from the thrust nozzles. Alternatively, the thrust nozzles can each be arranged on a radially outer end of a nozzle arm. This design requires little material so that the rotary drive can here be especially light in design.

Particularly for the purpose of low-cost manufacture, it is preferably provided that the nozzle carrier or the nozzle arm arrangement is formed by two half shells each being made of one piece, tightly connected with each other, and forming each one bottom part and one upper part. The parts are preferably injection-molded parts of thermoplastic material, such as polyamide (PA) and preferably fused with each other for a tight connection.

The centrifugal rotor is preferably rotatable about a vertically extending rotary axis. In this embodiment, the separator can be advantageously housed in an associated internal combustion engine, and negative effects of gravity on the separating function are avoided—such as may occur in other positions of the rotary axis, especially in a horizontal position.

To realize a simple manufacture of the separator and to be able to easily replace the centrifugal rotor of the separator in case of damage, the gas purification chamber is preferably enclosed by a housing part, particularly a component module or a cylinder head bonnet, or by a cover placed onto a base of the separator, which can be loosened and removed as needed, as well as mounted again.

One development provides that the base—apart from the part extending into the drive chamber—is essentially plate-shaped and that a bearing of the shaft being closest to the centrifugal rotor is arranged in the plate-shaped part of the base. In this design, the base is of a simple shape and can thus be manufactured at low cost.

Depending on the physical structure and the material of the base and of the part extending into the drive chamber, it may happen during the operation of the separator that the seats and the bearings provided therein are moved away from their optimal alignment relative to each other. So that such possibly occurring movements do not result in a deceleration of the shaft or in a speed reduction of the rotor, it is proposed that the seats or the bearings are designed as or with spherical caps which are alignable in the longitudinal direction of the shaft.

To prevent that lubrication oil creeps from the drive chamber along the shaft through the base into the gas purification chamber and thereby interfering with the function of the separator, it is proposed that the base, on the one hand, and the shaft, on the other hand, form a noncontact gap or thread seal.

For the purpose of realizing a separator operation which is maintenance-free or as low in maintenance as possible, it is preferably provided that the centrifugal rotor is formed by a plate stacking separator with a number of stacked plates which are engaged with each other and/or with the shaft in a form-fitting and/or friction-locked manner.

The invention further proposes that the plates seen in their circumferential direction are wavy in design and that with two each directly adjacent plates in the stack of plates, one wave crest of the one plate is opposite a wave trough of the other plate. This design provides the individual plates with a high stability of form at minor material thickness and thus advantageously low weight. At the same time, channels are thus formed between the adjacent plates through which the gas to be de-oiled is passed and effectively entrained in the direction of rotation. The waviness of the plates can be differently designed, e.g. in sinus wave form or in a zigzag form, or in a trapezoidal or rectangular form.

To secure the plates in the simplest possible and yet reliable manner among each other as well as relative to the shaft in rotary direction and in axial direction, the invention further proposes that the plates forming a stack of plates are enclosed by a stacking bottom on the underside and by a stacking top on the upper side, that the stacking bottom or the stacking top rests on the shaft, and that a pre-stressing force is applied to the stacking bottom and the stacking top pressing them on with the intermediate layer of the plates.

Another contribution for achieving a simple and yet reliable construction is that the aforementioned pre-stressing force is preferably generated by a spring seated on the shaft and resting on the shaft, on the one hand, and on the stacking bottom or the stacking top, on the other hand.

To prevent that crankcase ventilation gas to be de-oiled bypasses the centrifugal rotor, it is furthermore provided according to the invention that the stacking bottom in its radially outer area forms a labyrinth seal with the base and that the crude gas inlet into the gas purification chamber is located radially within the labyrinth seal. The labyrinth seal can be advantageously friction-free in design so that—without contact of the counter-rotating parts of the labyrinth seal—a sufficiently tight seal against a penetration of crankcase ventilation gas is achieved. The entire flow of the crankcase ventilation gas is thereby reliably passed through the centrifugal separator, and very good oil mist separation from the gas is thus ensured.

To pass the crankcase ventilation gas to be de-oiled in the simplest possible way and manner into the gas purification chamber, the crude gas inlet preferably runs through a housing part, particularly a component module or a cylinder head bonnet, or through the base.

So that the centrifugal rotor, seen over its circumference, is uniformly charged with crankcase ventilation gas to be de-oiled, a crude gas channel is preferably arranged in the base extending in its circumferential direction; from said channel, a plurality of passage openings spaced apart from each other in circumferential direction extends as crude gas inlets into the gas purification chamber.

It is furthermore preferable provided that the pure gas outlet extends through the cover towards the outside. The pure gas outlet is thus relatively far removed from the crude gas inlet so that inlet and outlet cannot interfere with each other in their arrangement.

To integrate another function in the separator according to the invention and to thus save manufacturing costs and assembly space, the invention furthermore proposes that a crankcase pressure regulating valve is built into the cover or onto the cover, with the pure gas outlet extending through the crankcase pressure regulating valve. In addition to the oil mist separation from the crankcase ventilation gas, the separator including the pressure regulating valve then also ensures that a desired pressure within the crankcase of the associated internal combustion engine is complied with.

For the purpose of realizing simple manufacturing, at least one part of a housing of the pressure regulating valve is preferably executed as one piece with the cover. This one-piece execution suggests itself particularly for a manufacture with plastic injection molding or with light-metal die casting.

To supply the pressurized lubrication oil required for the rotary drive to the at least one thrust nozzle in the most simple way possible, on the one hand, and, on the other hand, in the most reliably possible manner, it is preferably provided according to the invention that the shaft is hollow over one part of its length and forms an oil channel, that the pressurized lubrication oil is introducible via a rotary transmission into the oil channel, and that the lubrication oil can be supplied to the at least one thrust nozzle—through the oil channel and through one branch channel each per thrust nozzle branching off from the oil channel.

Advantageously, the branch channels are designed in streamlined bends with large radii. This design avoids sharp deflections of the drive oil flow and connected pressure losses which results in a low oil requirement for the drive and simultaneously high speeds of the centrifugal rotor.

To reliably remove from the gas purification chamber the oil separated by means of the centrifugal rotor from the crankcase ventilation gas—without the oil re-entering the gas flow of the crankcase ventilation gas and thereby being able to undesirably get into the pure gas outlet an annularly circumferential oil collecting through is preferably provided in an upper side area of the base radially outside of the centrifugal rotor; and from said trough, an oil return channel branches off forming the oil outlet. In this oil collecting trough, the oil can collect after separating by centrifugal effect, depositing on the inside circumference of the gas purification chamber and flowing downwardly due to the effect of gravity—without the gas flow in the gas purification chamber being able to still effectively capture the oil within the oil collecting trough. The oil outlet expediently leads into the oil pan of the associated internal combustion engine so that the separated oil is again made available for the lubrication of the internal combustion engine.

It is advantageous for a high rotor speed if the lubrication oil, after its exit from the at least one thrust nozzle, does not come into contact with rotating parts of the separator because such contact would result in a deceleration. To prevent such deceleration even in crowded space conditions, the invention proposes that—in the drive chamber, radially outside from a circular path of the at least one thrust nozzle—an oil retainer is arranged which deflects lubrication oil exiting from the thrust nozzle from moving parts of the rotary drive.

In a first embodiment, the oil retainer comprises a plurality of lamellae which, seen in circumferential direction, are arranged spaced apart from each other and extend axially in parallel with the shaft, with one surface level of the lamellae extending transversely to the radial direction of the oil retainer. With such arranged lamellae, an oil jet from the thrust nozzle can be deflected into a direction which extends at least approximately tangentially to the inside circumference of the drive chamber—which prevents or reduces an interfering reflection of the oil jet.

The surface level of the lamellae preferably forms each an angle of between 0° and 45° to one jet direction of a lubrication oil jet exiting from the thrust nozzle and flowing against the lamellae.

In a second embodiment, the oil retainer comprises a plurality of lamellae which, seen in axial direction, are arranged spaced apart from each other and extend concentrically to the shaft in circumferential direction, with one surface level each of the lamellae extending transversely to the radial level of the oil retainer. With lamellae of this type as well, the jet oil from the thrust nozzle can be deflected into a direction which keeps the oil jet away from moving parts of the drive.

The surface level of the lamellae each preferably forms an angle of a maximum of 45° to the radial level of the oil retainer.

In a third embodiment in this respect, the oil retainer comprises a plurality of lamellae which are arranged spaced apart from each other as well as transversely in an intermediate direction between a path extending parallel to the shaft and concentrically to the shaft. With such lamellae, the oil jet can be deflected into two spatial directions to divert it particularly safely away from moving drive elements.

A good effect is achieved if one longitudinal direction of the lamellae each forms an angle of between 30° and 60° to the axial direction of the oil retainer.

Seen in cross-section, the lamellae of the oil retainer can be flat or concave, or convex bent or cambered or comprise a bearing surface profile.

Alternatively, the oil retainer may be bell-shaped, with one open side of the retainer showing in a direction facing away from the centrifugal rotor. With the bell shape as well, the oil jet from the thrust nozzle can be deflected into a direction which leads the oil jet away from moving parts of the drive.

Particularly because of low-cost manufacture, the complete oil retainer or one part of the oil retainer is preferably designed as one piece with the base. Alternatively, the retainer by itself may be produced in one or multiple pieces and inserted into the drive chamber or connected with the base.

Different internal combustion engines produce in their operation different amounts of crankcase ventilation gas and crankcase ventilation gas with different oil mist concentrations. To take these differences into account and, at the same time, enable a very economical manufacture of the separator in a design adjusted to the corresponding case of application, it is provided that the separator can be modularly produced by means of a modular system in different designs, especially in different sizes, wherein a uniform base and/or a uniform rotary drive can be connected with one of a plurality of the different centrifugal rotors and/or with one of a plurality of different covers. Aside from their size, the covers may also differ e.g. in that they are optionally designed with or without an integrated pressure regulating valve.

The second part of the above presented problem is solved according to the invention with a functional module of an internal combustion engine, characterized in that it comprises a separator according to any one of the claims 1 to 29. In this functional module, the separator is advantageously combined with one or a plurality of other components of an associated internal combustion engine which results in a good utilization of structural space and a simplified assembly.

The third part of the above presented problem is solved in accordance with the invention with an internal combustion engine and with a separator according to any one of the claims 1 to 29, wherein the internal combustion engine is characterized in that a mounting flange is provided on it on which the separator or the functional module can be mounted by creating flow connections. This mutual coordination and adjustment of internal combustion engine and separator or functional module will realize a simple and thus time- and cost-saving assembly since at least one part of the flow connections required for the operation and the function of the separator is already produced in the manufacture of the flange connection.

It is here preferably provided that the base and a/the cover of the separator can be jointly or individually mounted on the mounting flange. Joint mounting is especially advantageous for an initial assembly in the production of the internal combustion engine; individual mounting is expedient for subsequent maintenance and repair work when only the cover by itself is to be removed to gain access to the centrifugal rotor.

It is further preferably provided for the internal combustion engine that the drive chamber is located within the internal combustion engine under or behind the mounting flange. In this manner, the space required by the separator outside of the internal combustion engine is kept particularly small which results in a very compact design. The drive chamber located in the internal combustion engine can be arranged, for example, in an engine block or a cylinder head, or a cylinder head bonnet of the internal combustion engine.

The invention further proposed that a first bearing of the shaft is arranged in the base and a second bearing of the shaft is arranged in the drive chamber located in the internal combustion engine. In this embodiment, a large space of the bearings from each other is rendered possible which keeps the forces acting upon the shaft transversely to its longitudinal direction advantageously small, and the burden on the bearings is thereby also kept low. This contributes to a particularly long, maintenance-free service life of the bearings and thus of the separator altogether.

A further development provides that the second bearing of the shaft, arranged in the drive chamber located in the internal combustion engine, lies in the part with the seat extending into the drive chamber, the part being designed as part of the base. This design is particularly advantageous in that both seats for the bearings of the centrifugal rotor are located in one component, namely in the base, and thereby alignment errors in the alignment of the bearings can thus be easily prevented. The seat extending into the drive chamber can be designed as one piece with the rest of the base or be firmly connected with it.

To realize the simplest possible guidance of the pressurized lubrication oil into the shaft, one embodiment of the invention proposes that an oil channel—forming the pressurized oil feed for the pressurized lubrication oil within the internal combustion engine—leads into the oil channel in the shaft on the second bearing, preferably in axial direction. This type of rotary transmission is technically very simple which keeps the construction advantageously low-cost. At the same time, reliable, good lubrication of at least the second bearing is achieved which is ensured without special additional measures.

To prevent any functional impairment and wear in and on the separator due to soil particles contained in the pressurized lubrication oil, the pressurized lubrication oil for the rotary drive of the centrifugal rotor is expediently diverted from one clean side of a lubrication oil circulation of the internal combustion engine, thus, particularly seen in the direction of the oil flow, behind an oil filter of the internal combustion engine.

Alternatively, the pressurized lubrication oil for the rotary drive of the centrifugal rotor can be diverted from one crude side of a lubrication oil circulation of the internal combustion engine, thus, particularly seen in the direction of the oil flow, between an oil pump and an oil filter of the internal combustion engine. This embodiment has the specific advantage that the lubrication oil here has its maximum pressure and thus offers a maximum drive power for the centrifugal rotor.

To avoid as far as possible external channels, for example in the form of piping or hoses since they require additional manufacturing and assembly expenditures, it is provided in accordance with the invention that a crude gas channel forming a crude gas inlet within the internal combustion engine leads into the mounting flange and there into the circumferential crude gas channel or directly into the passage openings in the base plate.

For the same reason, the oil outlet is passed through the mounting flange into the internal combustion engine so that here as well no external line needs to be produced and connected.

Finally, also for the aforementioned reason, a pressureless oil discharge channel is provided, within the internal combustion engine, which discharges from the drive chamber the lubrication oil exiting from the at least one thrust nozzle.

BRIEF DESCRIPTION OF THE DRAWINGS

In the following, exemplary embodiments of the invention are explained by means of a drawing. In the Figures of the drawing.

DETAILED DESCRIPTION OF THE PREFERRED EMBODIMENTS

Figure 1:
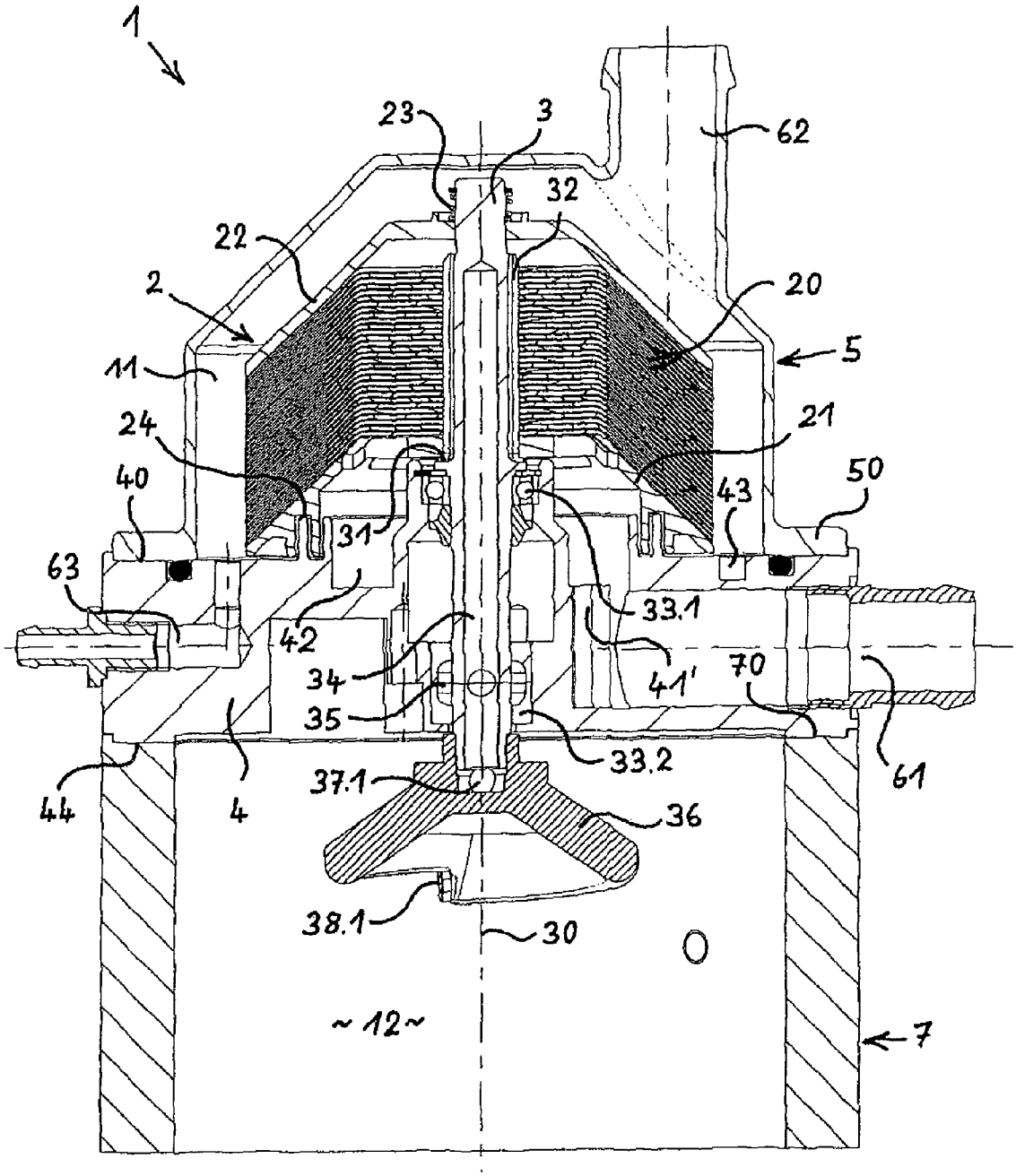
FIG. 1 shows a separator which is flanged to an internal combustion engine, in a first embodiment in longitudinal section.

FIG. 1 of the drawing shows a first separator 1 in a longitudinal section which extends in an essentially vertical plane, wherein the separator 1 is flanged to an internal combustion engine 7 here also presented sectionally in a very small part.

The separator 1 comprises in its upper area a gas purification chamber 11 and in its lower area a drive chamber 12. The gas purification chamber 11 and the drive chamber 12 are separated from each other by a base plate 4. The gas purification chamber 11 is limited towards the outside by a cover 5 which is sealingly set onto the upper side 40 of the base plate 4.

The drive chamber 12 located under the base plate 4 lies within the internal combustion engine 7 and is laterally and downwardly limited by it.

A rotatable shaft 3 extends through the base plate 4 and is provided in an upper bearing 33.1, here a rolling bearing, and in a bottom bearing 33.2, here a friction bearing. The two bearings 33.1 and 33.2 are both arranged in the base plate 4 spaced apart from each other.

On an upper part of shaft 3 which is located in the gas purification chamber 11, a centrifugal rotor 2 is provided which is formed of a plurality of plates 20 stacked atop each other which each have a conical jacket shape. The plates 20 are positioned in a torsion-proof manner by means of ribs 32 provided on the outer circumference of the shaft 3 and spaced apart from each other in circumferential direction. Moreover, the individual plates 20 interconnect in a form-fitting manner whereby the plates 20 are also secured against torsional stress among each other.

A stacking bottom 21 is arranged underneath the stack of plates 20. A stacking top 22 is arranged at the upper end of the stack of plates 20. The stacking bottom 21 is supported towards the bottom on one step 31 of shaft 3 in axial direction. By means of a helical spring 23, the above arranged stacking top 22 is applied with a pre-stressing force acting downwardly, i.e. towards the stacking bottom 21. The helical spring 23 is here arranged on the upper end of the shaft 3 and surrounds it. The upper end of spring 23 rests on a ring connected with shaft 3, while the bottom end of spring 23 presses on the top side of the stacking top 22. The stacking top 22 and the stacking bottom 21 are thereby pressed against each other, with the intermediate position of the plates 20, whereby the centrifugal rotor 2 is additionally stabilized.

The lower end of shaft 3 is located in drive chamber 12 below the base plate 4 and is connected with a rotary drive which is used to generate a rotation of the centrifugal rotor 2. The rotary drive here consists of two thrust nozzles of which only thrust nozzle 38.1 is visible in the sectional view according to FIG. 1. Thrust nozzle 38.1 and the second thrust nozzle lying before the sectional plane are mounted on a nozzle carrier 36 which has the basic conical jacket shape and is connected torsion-proof with the lower end of the shaft 3.

To drive the centrifugal rotor 2, pressurized lubrication oil of the associated internal combustion engine 7 is used which is introduced by means of a rotary transmission 35 into the hollow interior of shaft 3 which forms an oil channel 34. At the lower end of shaft 3, the oil channel 34 is in connection with two branch channels, of which only the first branch channel 37.1 is here visible which leads to the thrust nozzle 38.1. As soon as pressurized lubrication oil is supplied, the centrifugal rotor 2 is driven according to the recoil principle. In this manner, shaft 3 is made to rotate fast with the centrifugal rotor 2 about the rotary axis 30.

The lubrication oil exiting from the thrust nozzles 38.1 flows without pressure into the drive chamber 12 and from it preferably into an oil pan of the associated internal combustion engine 7.

Crankcase-ventilation gas burdened with oil mist is supplied to the separator via a crude gas inlet 61 designed as a connecting nozzle. By means of one or a plurality of passage openings 41', the crankcase ventilation gas gets into a zone of the gas purification chamber 11 which is radially inside of the centrifugal rotor 2 and located underneath it. Via a deepened ring area 42 in the upper side 40 of the base plate 4, the inflowing crankcase ventilation gas is uniformly distributed in circumferential direction and flows from there upwardly into the interior of the centrifugal rotor 2. For this, the plates 20 of the centrifugal rotor 2 have openings, in a manner known per se, in their radially internal area which allow a distribution of the gas over the height of the stack of plates 20. From the radially internal area, the crankcase ventilation gas then flows—due to the centrifugal force occurring upon rotation of the centrifugal rotor 2—between the plates 20 in radial direction towards the outside, with entrained oil droplets impinging on the plates 20 and being deposited there. The inclined course of the radially external part of the plates 20 contributes to this. Oil deposited in the centrifugal rotor 2 flows under the effect of the centrifugal force towards the outside and is cast off from the outer circumference of the centrifugal rotor 2 and thus gets onto the inner surface of the cover 5 which encloses the gas purification chamber 11.

The oil deposited on the inner surface of the cover 5 flows downwardly under the effect of the force of gravity and arrives in an oil collecting trough 43 located radially outside from the centrifugal rotor 2 in the upper side 40 of the base plate 4. From the oil collecting trough 43, an oil outlet 63 extends which here ends in a line connection through which the separated oil can be discharged, preferably into the oil pan of the associated internal combustion engine 7.

The crankcase ventilation gas liberated from the entrained oil mist flows upwardly from the outer circumference of the centrifugal rotor 2 and into a there provided pure gas outlet 62 designed in one piece with the cover 5. This pure gas outlet 62 is here also designed as a line connection nozzle to which, for example, a hose line can be connected. Via the continuing line, the purified crankcase ventilation gas is preferably supplied to a suction tract of the associated internal combustion engine 7.

To prevent an overflow towards the outside of the crankcase ventilation gas burdened with oil mist from the area radially inside of the centrifugal rotor 2, the stacking bottom 21 forms a noncontact labyrinth seal 24 with the upper side 40 of the base plate 4.

By means of a cover flange 50, the cover 5 is sealingly set onto the upper side 40 of the base plate 4 and is secured on it by means of screws, for example.

The base plate 4 which bears all the parts of the separator 1 is, in turn, flanged with its underside 44 to a mounting flange 70 provided on the side of the internal combustion engine 7. The drive chamber 12 of the separator 1 thus lies within the internal combustion engine 7.

Figure 2:
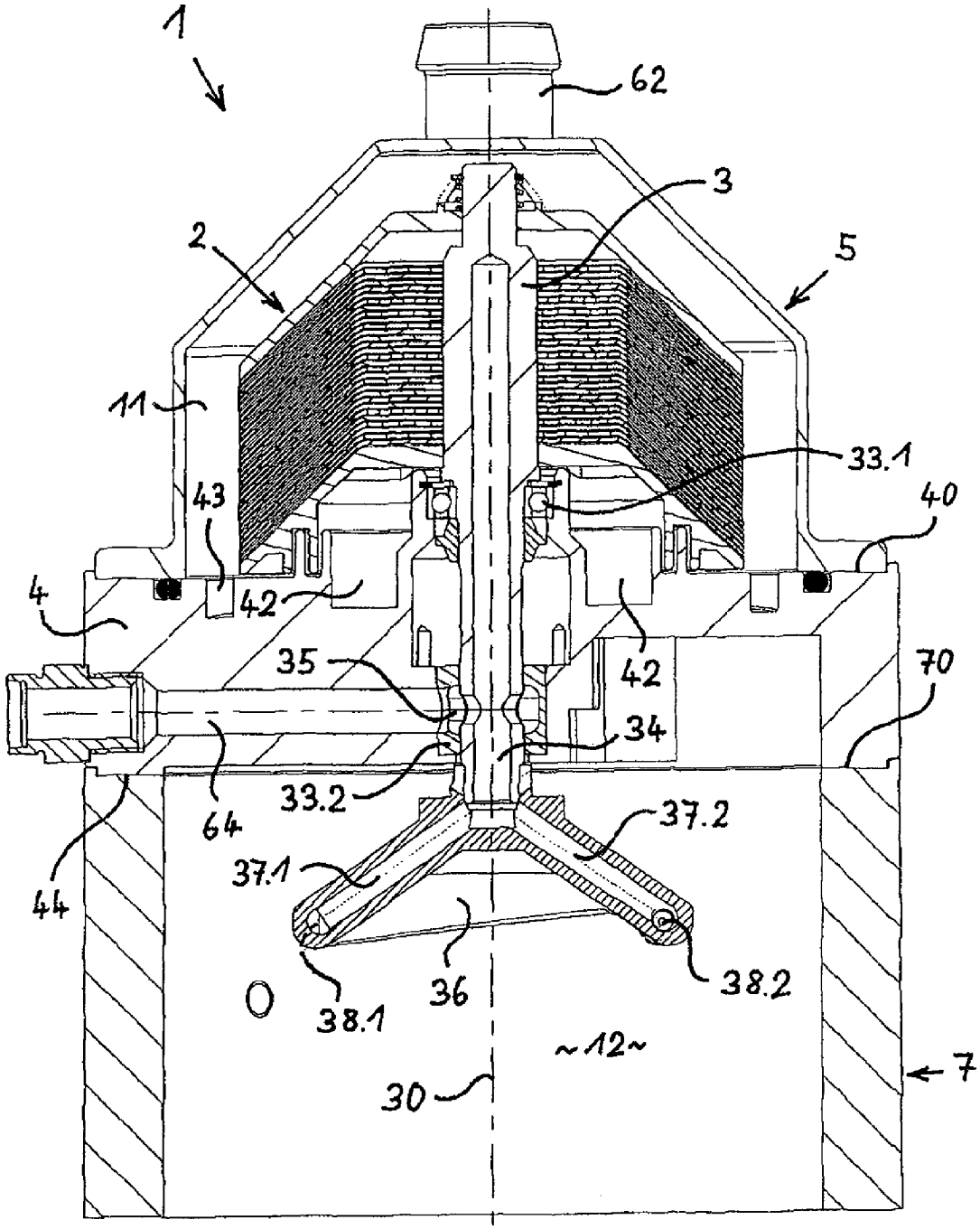
FIG. 2 shows the separator of FIG. 1 in a second longitudinal section, rotated by 90° versus FIG. 1.

FIG. 2 of the drawing shows the separator 1 of FIG. 1 in a sectional plane rotated by 90° versus FIG. 1. In the section according to FIG. 2, the nozzle carrier 36 now lies such that the first thrust nozzle 38.1 is visible on the left and the second thrust nozzle 38.2 on the right. The two branch channels 37.1 and 37.2 extend through the nozzle carrier 36 and, through them, lubrication oil—coming from the oil channel 34 in shaft 3—is passed to the thrust nozzles 38.1 and 38.2.

The pressurized lubrication oil is here passed to the separator 1 through a pressure oil feed 64 which extends according to FIG. 2 on the left side through the base plate 4 and is designed with a connecting piece to which an external pressure oil line can be connected. The pressure oil feed 64 leads to a rotary transmission 35 through which the pressurized lubrication oil passes over into the oil channel 34 formed in the shaft 3. The rotary transmission 35 is space-savingly arranged within the lower bearing 33.2 of shaft 3 which is designed as a friction bearing.

With regard to other visible details in FIG. 2, reference is made to the description of FIG. 1.

Figure 3:
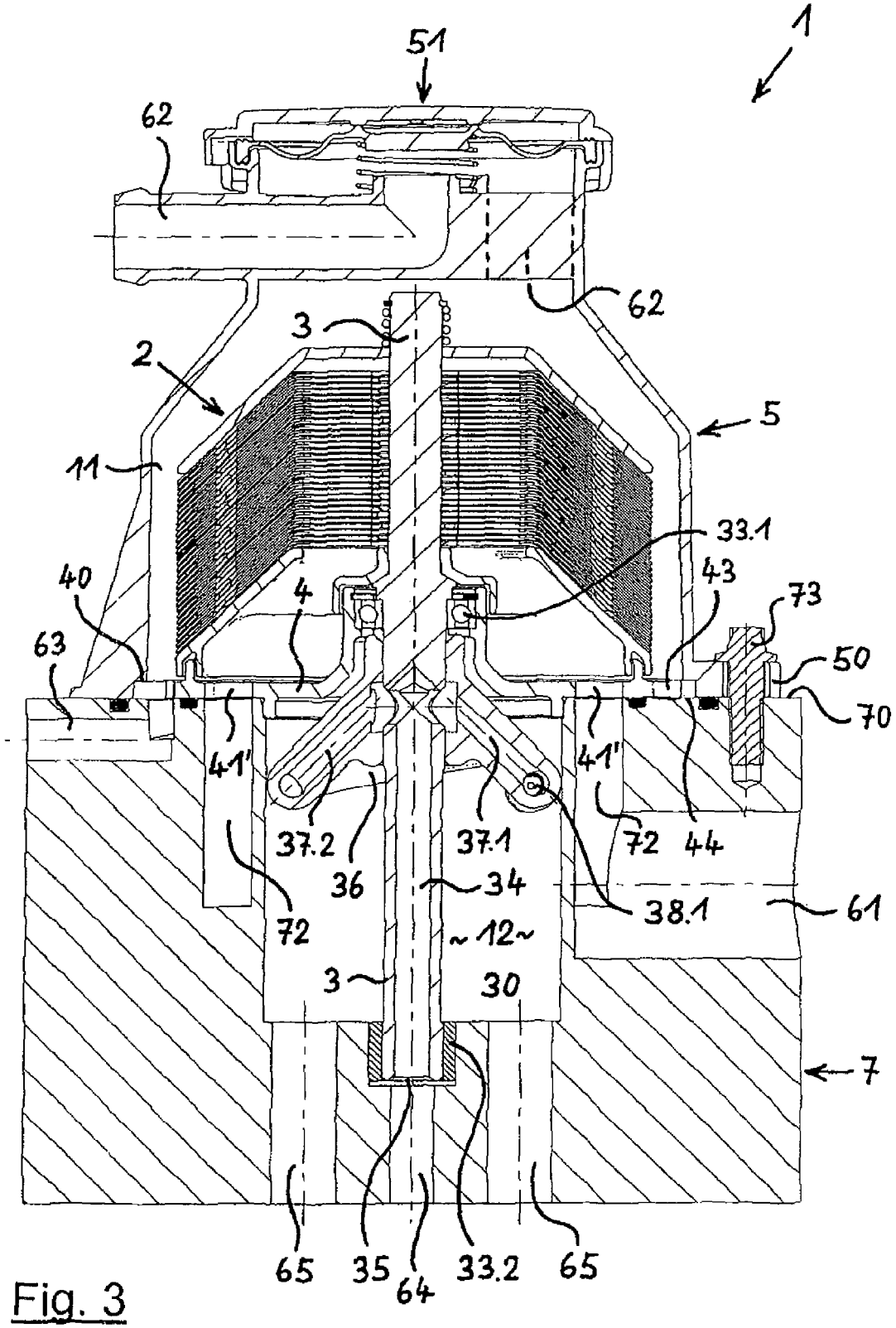
FIG. 3 shows the separator in a second embodiment with an integrated pressure regulating valve, in longitudinal section.

FIG. 3 of the drawing shows the separator 1 in a modified embodiment, with the first essential modification being that the second bearing 33.2 is not located in the base plate 4 but in the internal combustion engine 7. A second modification is that the cover 5 is now equipped with a crankcase pressure regulating valve 51.

Only the upper bearing 33.1 is arranged in the base plate 4 of the separator 1 according to FIG. 3; said bearing is here also provided as a rolling bearing. The bottom bearing 33.2 which is located in the internal combustion engine 7 is a friction bearing.

The nozzle carrier 36 is set upon the shaft 3 and is connected torsion-proof and resistant to displacement in axial direction. The supply of pressurized oil for driving the centrifugal rotor 2 is here provided in axial direction of shaft 3 from the bottom through a pressure oil feed 64 lying in the internal combustion engine 7. This pressure oil feed 64 is aligned with the oil channel 34 on the interior of shaft 3 which is hollow in its lower part. In this manner, the rotary transmission 35 for introducing the pressurized lubrication oil into the oil channel 34 is particularly simple.

The base plate 4 is here again connected with a mounting flange 70 provided on the side of the internal combustion engine 7, the base plate 4 here being sealingly clamped between the cover 5 and the mounting flange 70. The connection is here provided via the cover flange 50 through which several screws 73, distributed over the circumference, are passed into the internal combustion engine 7. One of these screws 73 is visible on the right in FIG. 3.

The thrust nozzles are here again arranged in a nozzle carrier 36 in the conical jacket shape, with only nozzle 38.1 being visible. One branch channel 37.1, 37.2 each leads to this thrust nozzle 38.1 and to the non-visible other thrust nozzle, and said channel is each connected with the oil channel 34 in shaft 3. The oil expelled via the thrust nozzles 38.1, 38.2 flows downwardly within the drive chamber 12 which here also lies within the internal combustion engine 7; and the oil flows further by gravity through two parallel oil discharge ducts 65 which preferably lead into the oil pan of the internal combustion engine 7.

The crude gas inlet 61 extending within the internal combustion engine 7 is used for the supply of the crankcase ventilation gas to be de-oiled. In a ring area 72 around the drive chamber 12 and separated from it, the inflowing gas is distributed in circumferential direction and enters via a plurality of passage openings 41' in the base plate 4 upwardly into the radially inner area of the gas purification chamber 11 underneath the centrifugal rotor 2. After flowing through the centrifugal rotor 2, the de-oiled gas flows upwardly and off via the pure gas outlet 62. The pure gas outlet 62 here extends through the pressure regulating valve 51 by means of which the gas pressure in the crankcase of the internal combustion engine 7 is kept within specifiable pressure limits.

For the discharge of the oil depositing on the inner surface of cover 5 due to the centrifugal effect of the centrifugal rotor 2, a circumferential oil collecting trough 43 in the upper side 40 of the base plate 4 radially outside of the centrifugal rotor 2 is also used here; said trough ends in the oil outlet 63, as can be seen on the left in FIG. 3.

With regard to the other details presented in FIG. 3, reference is made to the description of FIGS. 1 and 2.

Figure 4:
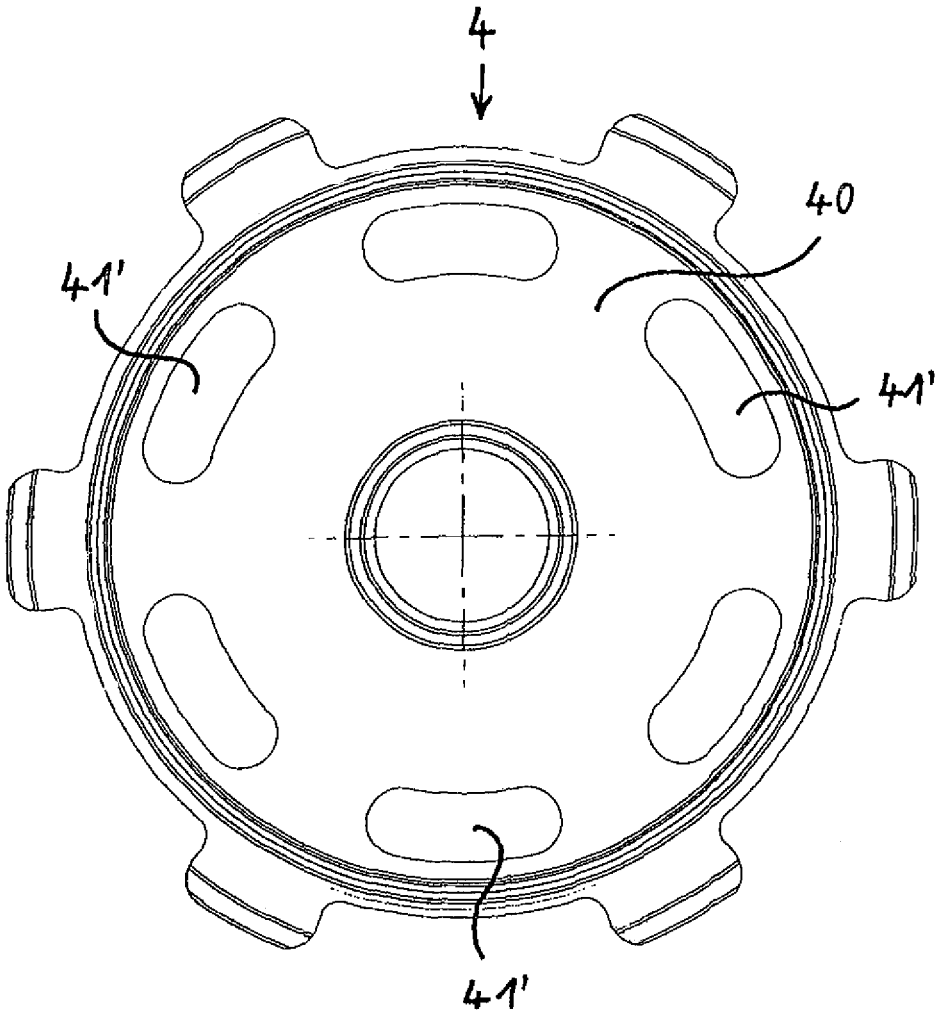
FIG. 4 shows a base plate of the separator of FIG. 3 as an individual part in a top view.

FIG. 4 shows as an individual part in a top view the base plate 4 of the separator 1 from FIG. 3. The base plate 4 is perforated in its center, and shaft 3, not shown in FIG. 4, runs through this opening.

Radially outside from the central opening, the passage openings 41' are uniformly distributed in circumferential direction and are used for supplying the crankcase ventilation gas to be de-oiled into the gas purification chamber which is located above the base plate 4.

Radially outside from the rim of passage openings 41', the oil collecting trough 43 is located in the upper side 40 of the base plate 4.

Figure 5:
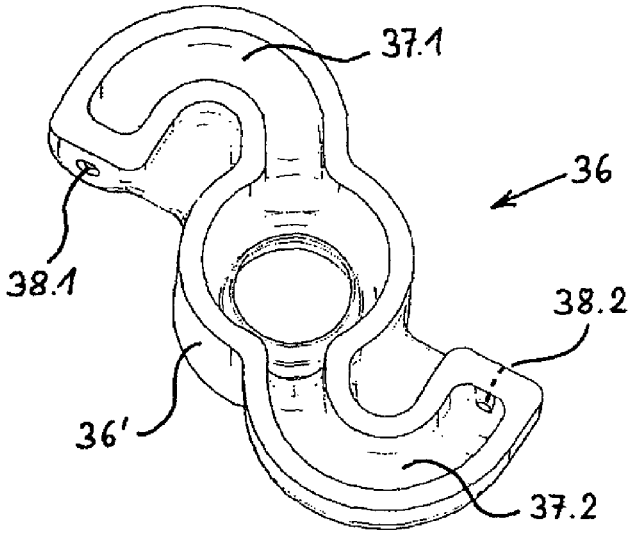
FIG. 5 shows one part of a nozzle carrier of the separator in a perspective view.

In a perspective top view, FIG. 5 shows a bottom part 36' of the nozzle carrier 36 in an embodiment modified versus FIGS. 1 to 3. Due to the viewpoint obliquely from the top, the branch channels 37.1 and 37.2 are visible which extend in the interior of the bottom part 36'. The beginning of these branch channels 37.1, 37.2 lies radially inside in a perforated area of the nozzle carrier 36 in which it is connected with the hollow shaft 3 not shown here. From shaft 3, pressurized lubrication oil flows into the branch channels 37.1 and 37.2. Due to the thrust nozzles 38.1 and 38.2 here formed in the material of the bottom part 36' and each arranged on the outer end of the channels 37.1 and 37.2, the lubrication oil exits in a direction extending approximately tangentially to the rotary axis, whereby the drive is effected according to the recoil principle.

As FIG. 5 further clarifies, the branch channels 37.1 and 37.2 extend in the example here shown in streamlined bends with large radii. This avoids sharp deflections of the oil flow and the pressure losses connected therewith which contributes to a low oil demand for the drive and high speeds of the centrifugal rotor.

Figure 6:
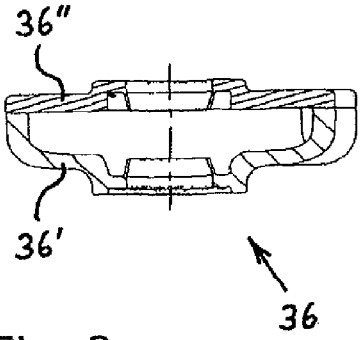
FIG. 6 shows the nozzle carrier of FIG. 5 in a completed condition, in cross-section.

FIG. 6 shows the nozzle carrier 36 of FIG. 5 in a cross-section, now in a completed, closed condition. For this, the bottom part 36'—presented by itself in FIG. 5—of nozzle carrier 36 is closed on its open upper side with an upper part 36". The bottom part 36' and the upper part 36" of the nozzle carrier 36 form two half shells and are preferably each one-piece plastic injection molded parts which are welded together for their joint. In their jointed condition, the bottom part 36' and the upper part 36" form the branch channels 37.1 and 37.2 which lead to the thrust nozzles. In FIG. 6, the center of the nozzle carrier 36 shows the opening for the shaft 3 not presented here with which the nozzle carrier 36 is connected in a torsion-proof manner.

Figure 7:
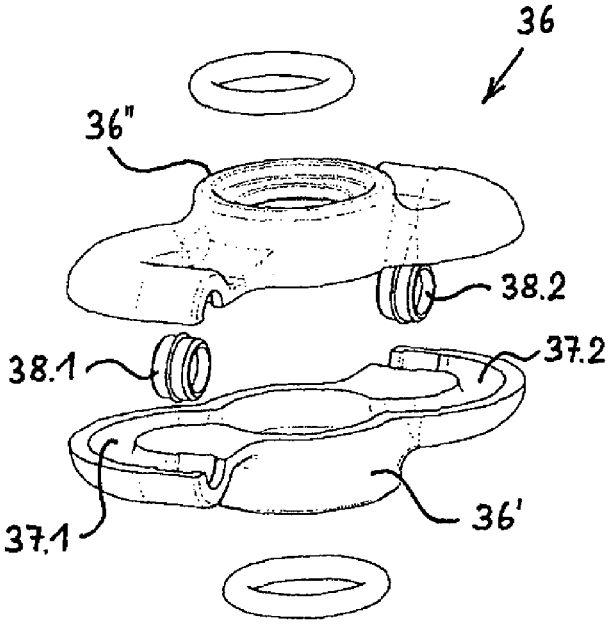
FIG. 7 shows the nozzle carrier in a modified embodiment in a perspective exploded presentation.
Figure 8:
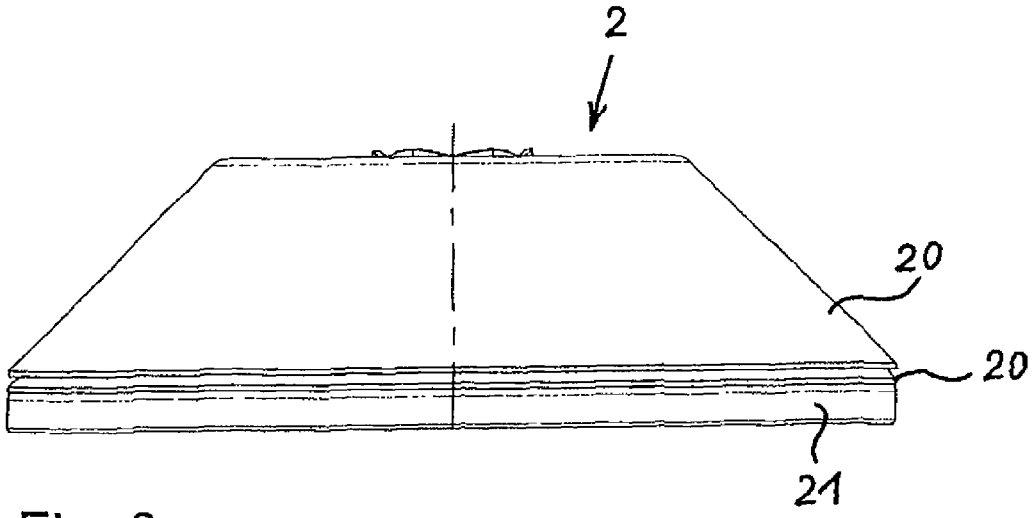
FIG. 8 to FIG. 11 show each one part of a centrifugal rotor of the separator in various presentations.
Figure 9:
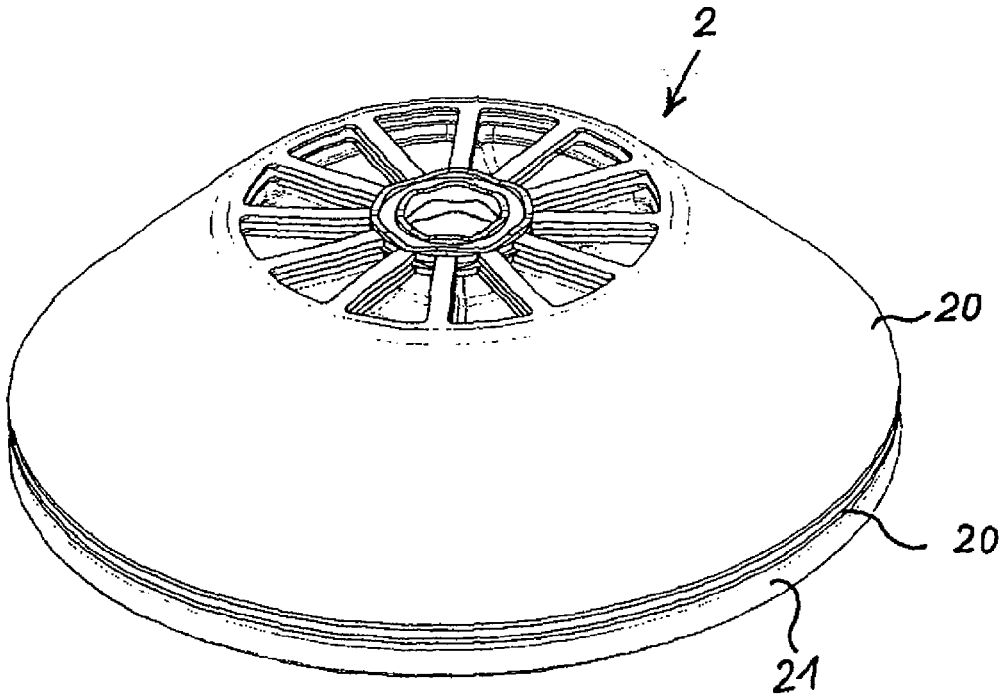

FIG. 7 shows an embodiment of nozzle carrier 36 which is modified versus the example according to FIGS. 5 and 6. The nozzle carrier 36 according to FIG. 7 also consists of a bottom part 36' and an upper part 36" which form two half shells and in their interior, they form, in jointed condition, the branch channels 37.1 and 37.2. In contrast to the example according to FIGS. 5 and 6, in the embodiment of nozzle carrier 36 according to FIG. 7, the thrust nozzles 38.1 and 38.2 are inserted as separate parts so that a different material, e.g. metal, can be used for the thrust nozzles 38.1, 38.2 than for the bottom part 36' and the upper part 36". Bottom part 36' and upper part 36" expediently consist of a thermoplastic material and are manufactured in an injection molding process. The connection between the two is provided, for example, by means of ultrasonic or friction welding. Via one upper and lower sealing ring each, a tight connection is provided with the shaft 3 which is not presented here.

FIGS. 8 to 11 each show one part of the centrifugal rotor 2 in a projection, in a perspective top view and in two different cross-sections. Of plates 20, the two bottom ones each are presented; and underneath them, in turn, the stacking bottom 21 is arranged. In a central area, each plate 20 has a contour which allows a form-fitting, torsion-proof placement at the respectively neighboring plate 20, here in the form of circumferential waviness.

Figure 10:
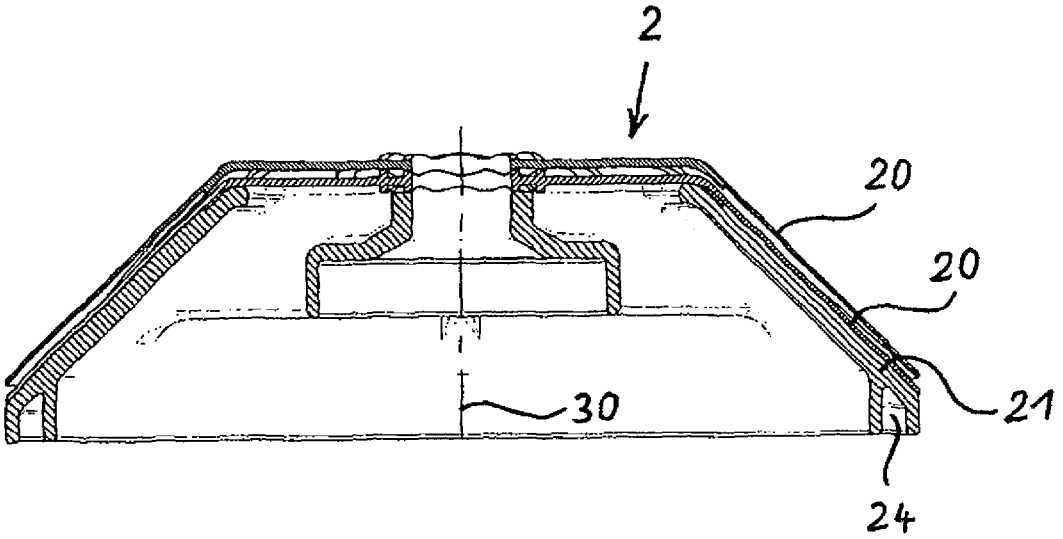
Figure 11:
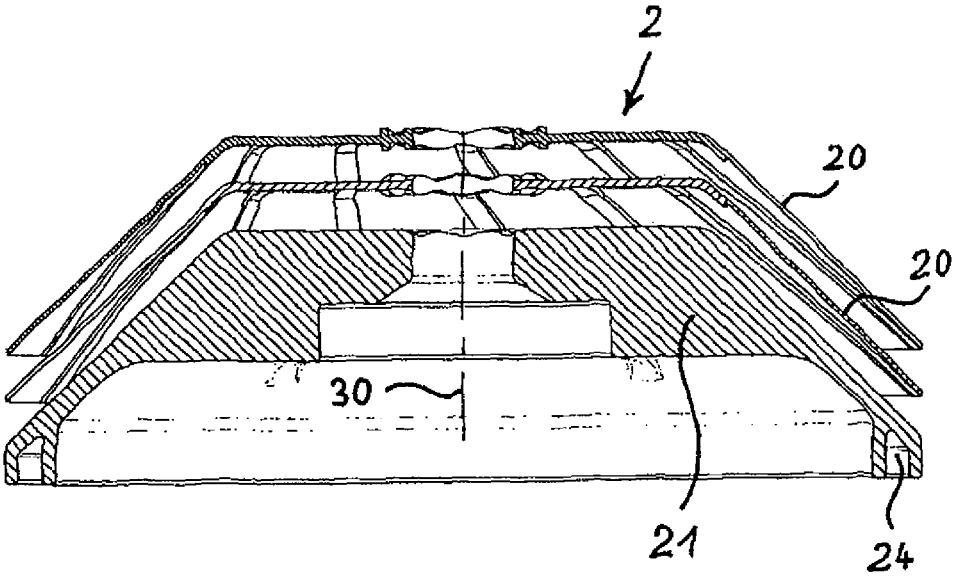

The mutual placement of plates 20 is particularly evident in the section according to FIG. 10. FIG. 11 shows the plates 20 at a distance from each other before they have arrived in their stacking position in which they lie closely one on top of the other by keeping an annular gap free. In FIGS. 10 and 11, the lower, radially outer edge each of the stacking bottom 21 visibly shows its allocated part of the labyrinth seal 24. The rotary axis 30 around which the centrifugal rotor 2 rotates in operation extends through the center of the plates 20 and of the stacking bottom 21.

Figure 12:
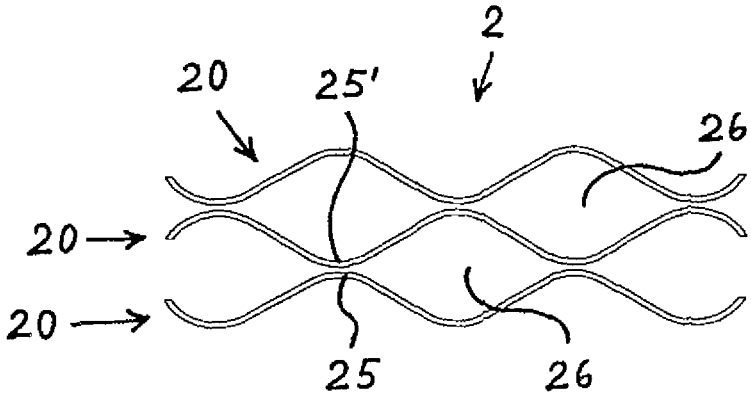
FIG. 12 and FIG. 13 show two embodiments of parts of the plates forming the centrifugal rotor in a partial section in circumferential direction.
Figure 13:
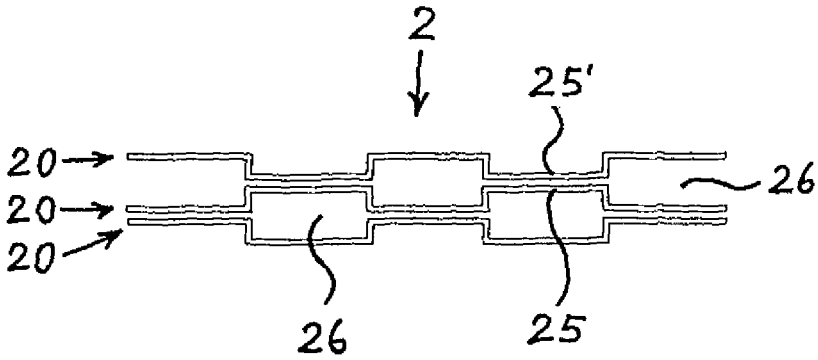

In FIGS. 8 to 11, plates 20 are presented which extend smoothly as seen in their circumferential direction. FIGS. 12 and 13 show two examples of plates 20 which are designed in a wavy form seen in their circumferential direction. In FIG. 12, the waviness is approximately sinusoidal, in FIG. 13 approximately rectangular. Other wave contours are conceivable. Independent of the waveform, two neighboring plates 20 in the stack of plates are each arranged such that a wave crest 25 of the one plate 20 is opposite a wave trough 25' of the other plate 20. In this manner, stable plates 20 are created, as well as defined gas channels 26 formed between the plates 20.

FIGS. 12 and 13 show two exemplary embodiments of the centrifugal rotor 2 of the separator based on a partial section—extending in circumferential direction of the centrifugal rotor—through two of the plates 20 which form the centrifugal rotor 2.

It is characteristic for the plates 20 in the example according to FIG. 12 that they are seen wavy in design in circumferential direction, with the waviness here being approximately sinusoidal. Each plate 20 thereby forms a sequence of wave crests 25 and wave troughs 25'—seen in circumferential direction. Furthermore, two neighboring plates 20, seen in circumferential direction, are arranged relatively to each other in such a way that a wave crest 25 of the lower plate 20 coincides with the wave trough 25' of the upper plate 20. Channels 26 are formed thereby between the two plates 20 in the radial direction of the plates. The crankcase ventilation gas initially still burdened with oil mist flows through these channels in its passage through the centrifugal rotor 2; within the channels 26 and due to the rotation of the centrifugal rotor 2 and thus of the plates 20, the oil droplets are deposited on the respectively lower surface of the plates 20. There, the oil droplets flow in radial direction towards the outside, by forming larger oil drops, and finally, they are then cast off radially outwardly from the radially outer circumference of each plate 20. Due to the wavy design of the plates 20 seen in circumferential direction, separate gas flow guiding elements need not be provided on the plates 20 which simplifies their manufacture.

The example according to FIG. 13 shows an alternative form of the waviness which here has a rectangular form. Also in this arrangement according to FIG. 13, a wave trough 25' each of the upper plate meets a wave crest 25 of the lower plate whereby, here too, channels 26 extending in radial direction are formed between the plates 20 for the crankcase ventilation gas to be de-oiled.

Aside from extending in radial direction, the channels 26 with plates 20 according to FIGS. 12 and 13 may also extend obliquely and/or bent to the radial direction.

Figure 14:
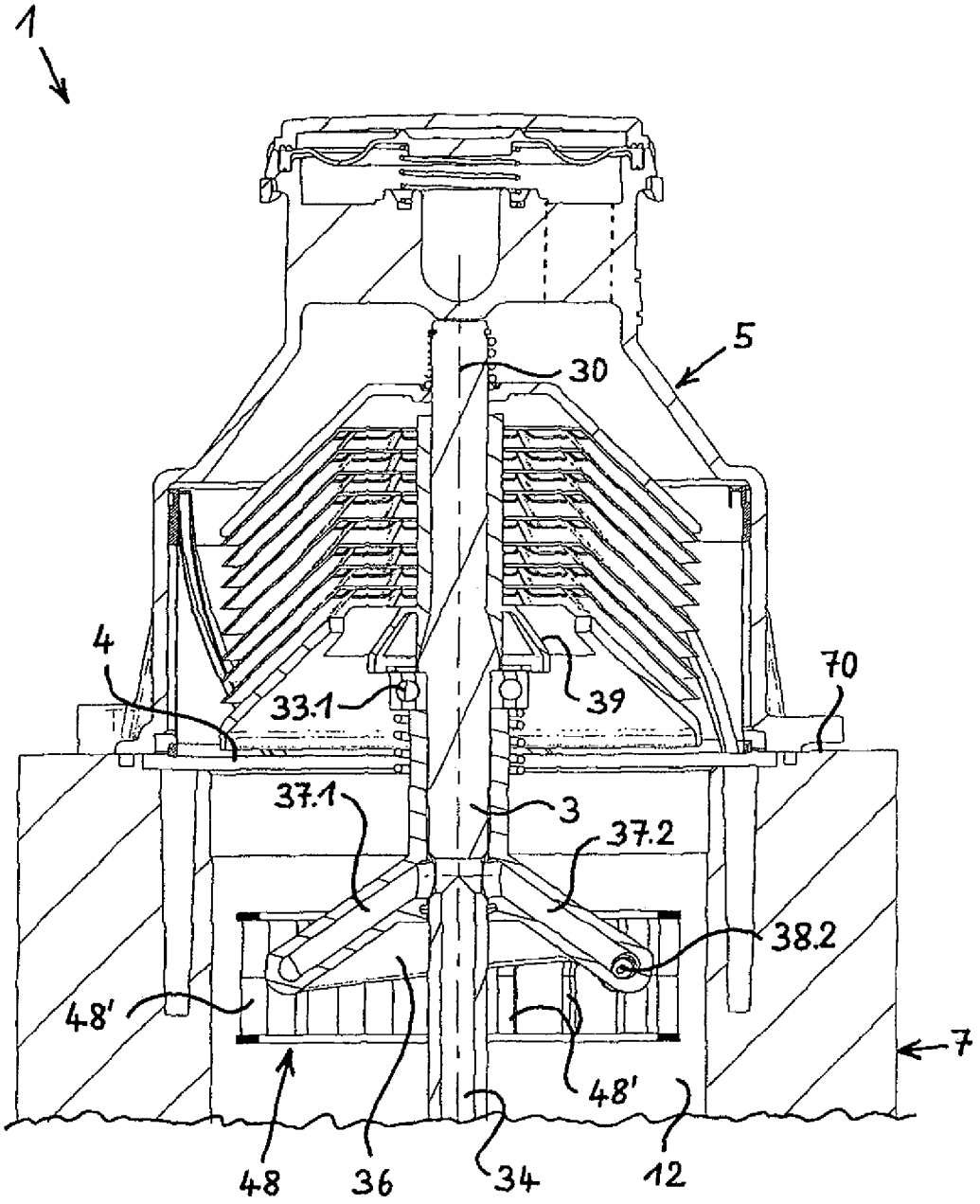
FIG. 14 shows the separator in a third embodiment with an oil retainer in the drive chamber in longitudinal section.

FIG. 14 shows another exemplary embodiment of a separator 1, again in a longitudinal section. Here as well, the separator 1 has a gas purification chamber 11 and underneath it a drive chamber 12, with these two chambers 11, 12 being separated from each other by the base 4 which has a plate shape here.

In the gas purification chamber 11, the centrifugal rotor 2 is arranged which is mounted on shaft 3. Together with shaft 3, the centrifugal rotor 2 is rotatable about the rotary axis 30.

In the drive chamber 12 into which the shaft 3 is entered through the base 4, the nozzle carrier 36 is arranged on the shaft and comprises the two branch channels 37.1 and 37.2 for the supply of thrust nozzles of which only the thrust nozzle 38.2 located on the right is visible here. The supply of pressurized lubrication oil is here provided from the bottom through the oil channel 34 which is formed in a hollow lower section of the shaft 3.

Radially outwardly from the nozzle carrier 36, an oil retainer 48 is arranged concentrically to the rotary axis 30 within the drive chamber 12. The oil retainer 48 essentially consists of an arrangement of lamellae 48' which are here provided in parallel to each other and in parallel to the rotary axis 30 of shaft 3, and which are spaced uniformly in circumferential direction in the oil retainer 48. The oil retainer 48 with its lamellae 48' serves to keep the lubrication oil, after its exit from the thrust nozzles 38.1 and 38.2, away from moving parts of the rotary drive in the drive chamber 12. A negative decelerating effect will thereby be prevented on the rotating parts within the drive chamber 12 due to the lubrication oil exiting from the thrust nozzles 38.1 and 38.2.

As already in the above described exemplary embodiments, the driving chamber 12 is here also located within an internal combustion engine 7 which has a mounting flange 70 on the upper side of the driving chamber 12. The base 4—here in the shape of a plate—and the cover 5 are sealingly flanged on the mounting flange 70.

Within the gas purification chamber 11, in its lower part, an upper bearing 33.1 is located for the bearing of shaft 3. Above the bearing 33.1, a shield ring 39 is connected in a torsion-proof manner with the shaft 3 and serves to prevent any passage of gas and oil along the shaft 3 and through the bearing 33.1 between the gas purification chamber 11 and the drive chamber 12—not only in the one direction but also in the other direction.

Figure 15:
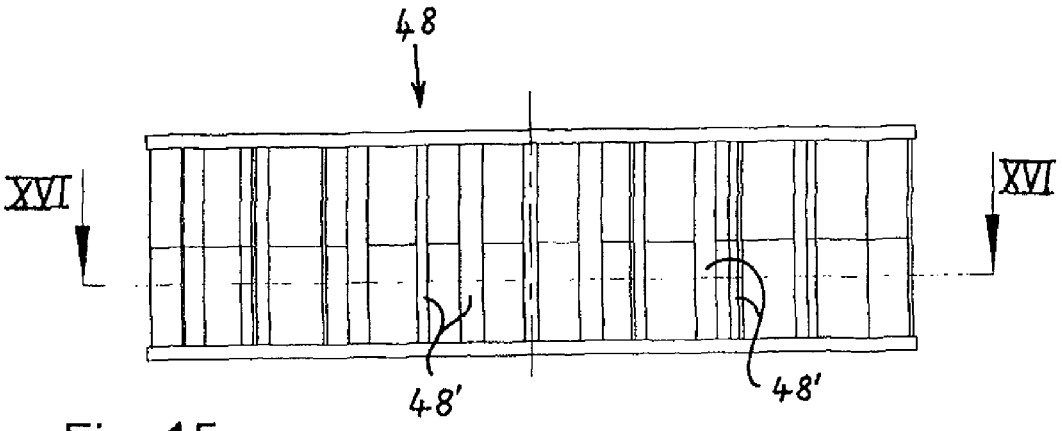
FIG. 15 shows the oil retainer of FIG. 14 as an individual part in a side view.

FIG. 15 shows the oil retainer 48 in a side view, with the multitude of lamellae 48' being visible and extending in parallel to each other.

Figure 16:
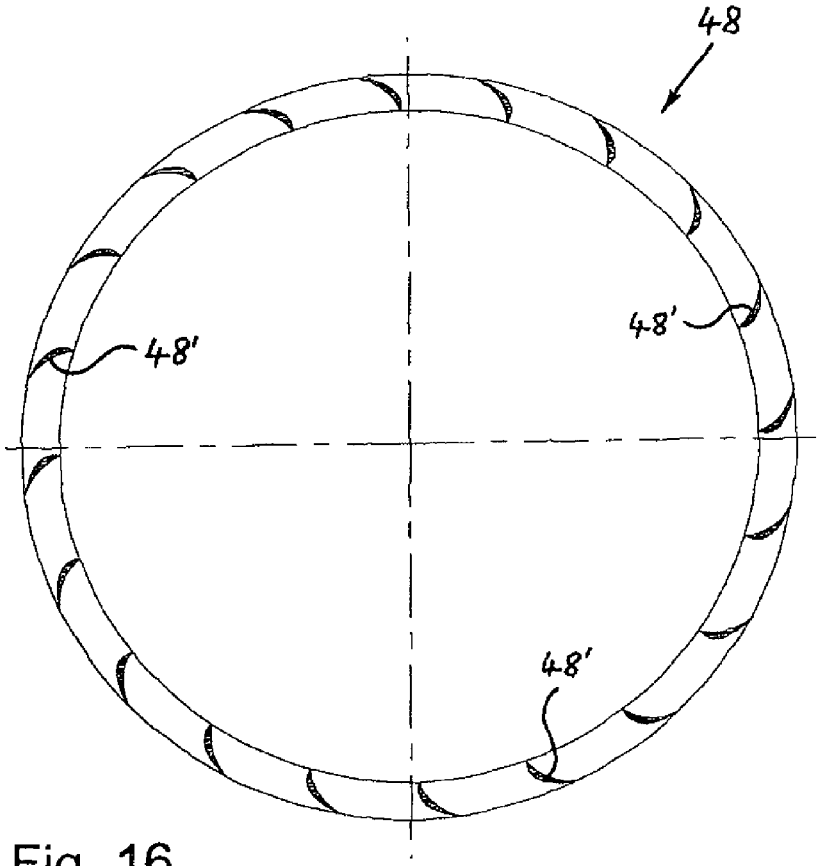
FIG. 16 shows the oil retainer of FIG. 15 in a section according to line XVI-XVI in FIG. 15.

FIG. 16 shows the oil retainer 48 of FIG. 15 in a cross section according to the section line XVI-XVI in FIG. 15. FIG. 16 particularly illustrates the form of the lamellae 48' which are here designed in the way of lightly bent blades to apply a favorable guiding effect on the oil jet exiting from the thrust nozzles. The guiding effect is here selected such that the lubrication oil exiting from the thrust nozzles passes through the oil retainer 48 and its lamellae 48' in radial direction towards the outside, but it can no longer return in the reverse direction to the moving parts of the rotary drive. This prevents an undesirable decelerating effect on the rotary drive due to the lubrication oil exiting from the thrust nozzles.

Figure 17:
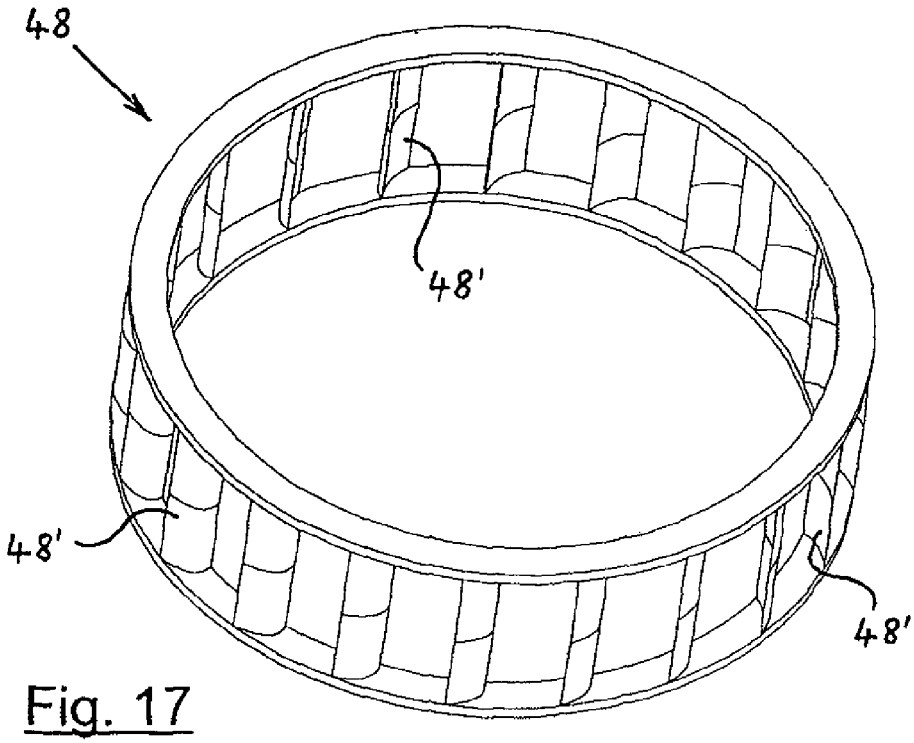
FIG. 17 shows the oil retainer of FIG. 14 as an individual part in a perspective view.

FIG. 17 shows a perspective view obliquely from above onto the oil retainer 48 and on the lamellae 48' uniformly distributed in circumferential direction, with their arrangement and shape here becoming particularly clear. Moreover, FIG. 17 illustrates that the oil retainer 48 can be advantageously manufactured as an injection molded part, with one upper and lower half at first being separately manufactured and then connected with each other along a middle separating plane. This plane in which the two halves of the oil retainer 48 are connected is indicated by a line each approximately in the longitudinal center of the lamellae 48'.

Figure 18:
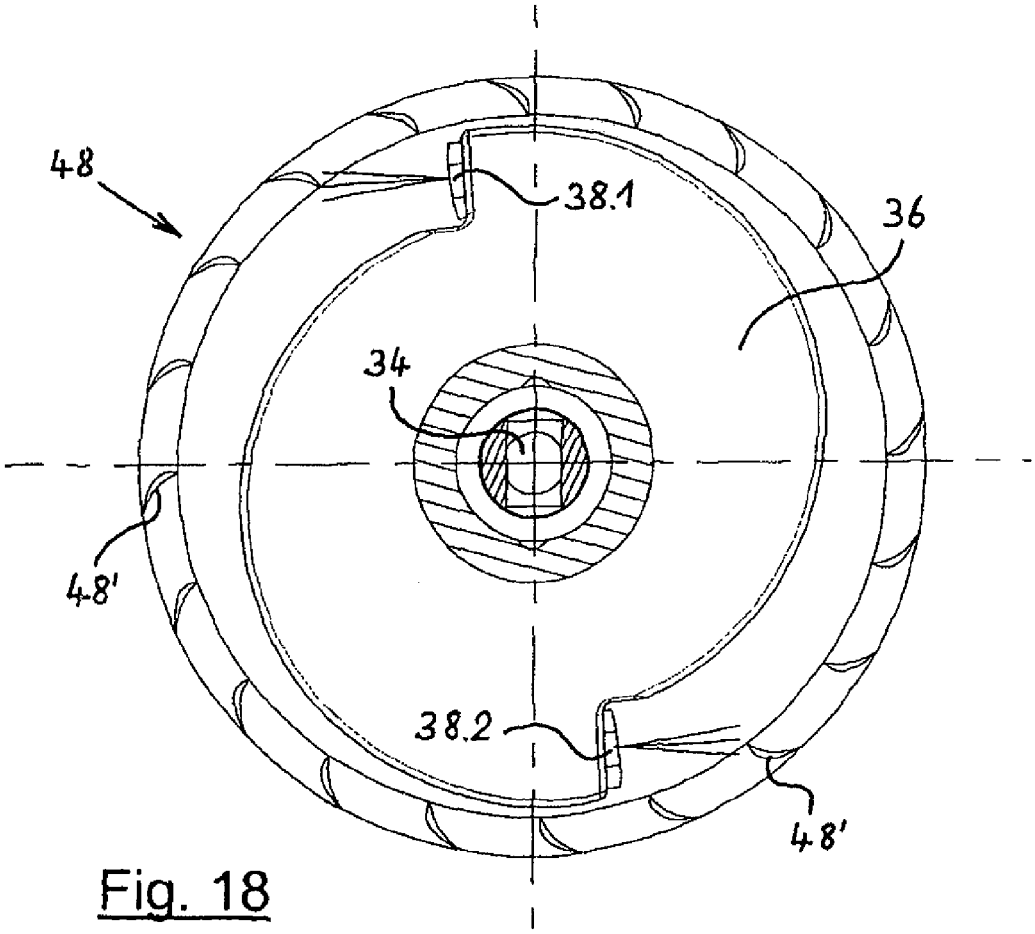
FIG. 18 shows the oil retainer of FIG. 14 together with a nozzle carrier with two thrust nozzles in a top view.

FIG. 18 presents the function of the oil retainer 48 together with the nozzle carrier 36 and the thrust nozzles 38.1 and 38.2 provided therein. It can here be seen that the lubrication oil exiting from the thrust nozzles 38.1, 38.2 can virtually flow unhindered between the lamellae 48 towards the outside because the lamellae 48' are correspondingly aligned. However, the oil retainer 48 with the lamellae 48' largely prevents any rebounding of parts of the lubrication oil from the walls delimiting the drive chamber 12 in the direction towards the nozzle carrier 36.

Figure 19:
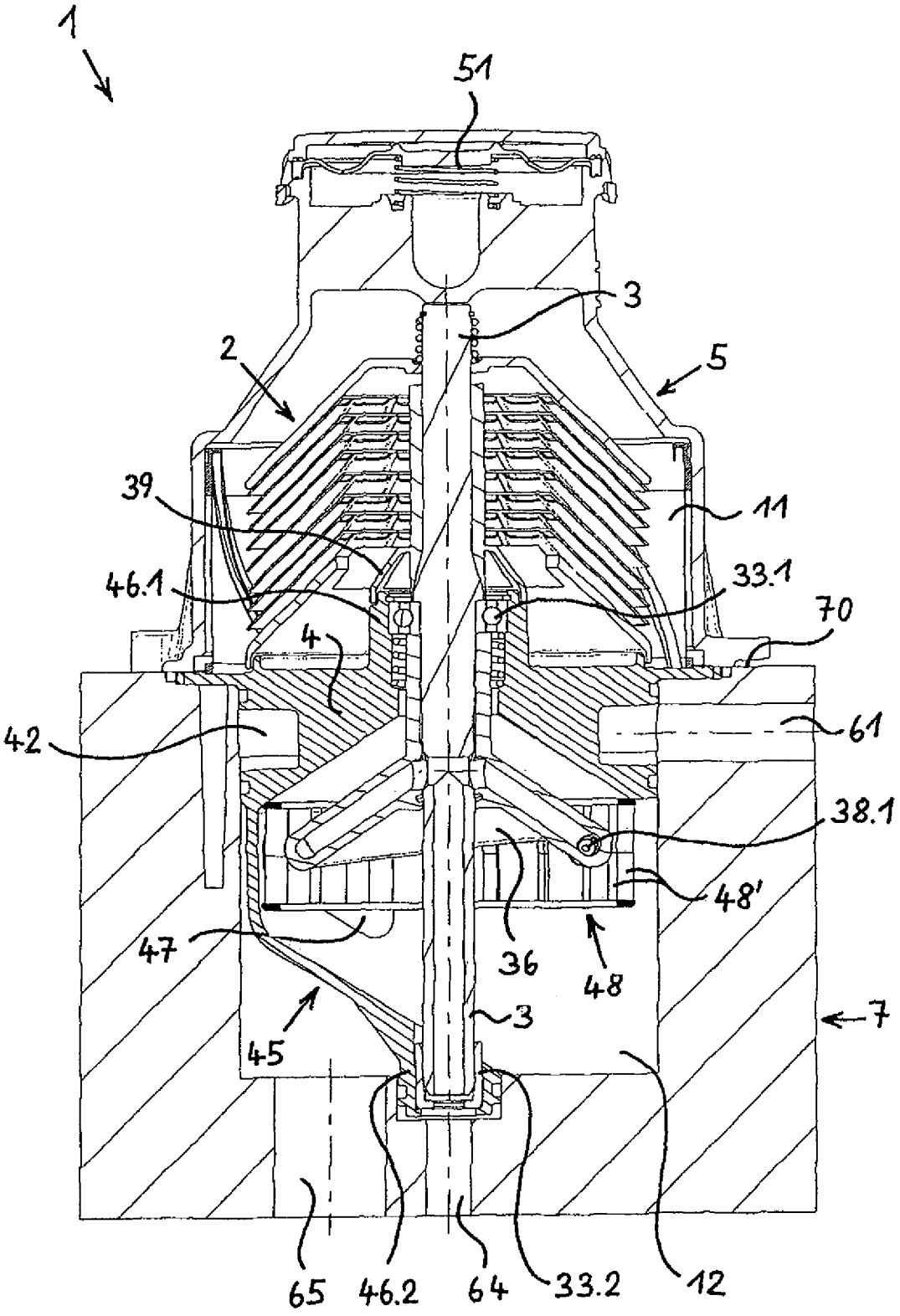
FIG. 19 shows the separator in a fourth embodiment with a base extending into the drive chamber, in a first longitudinal section.
Figure 20:
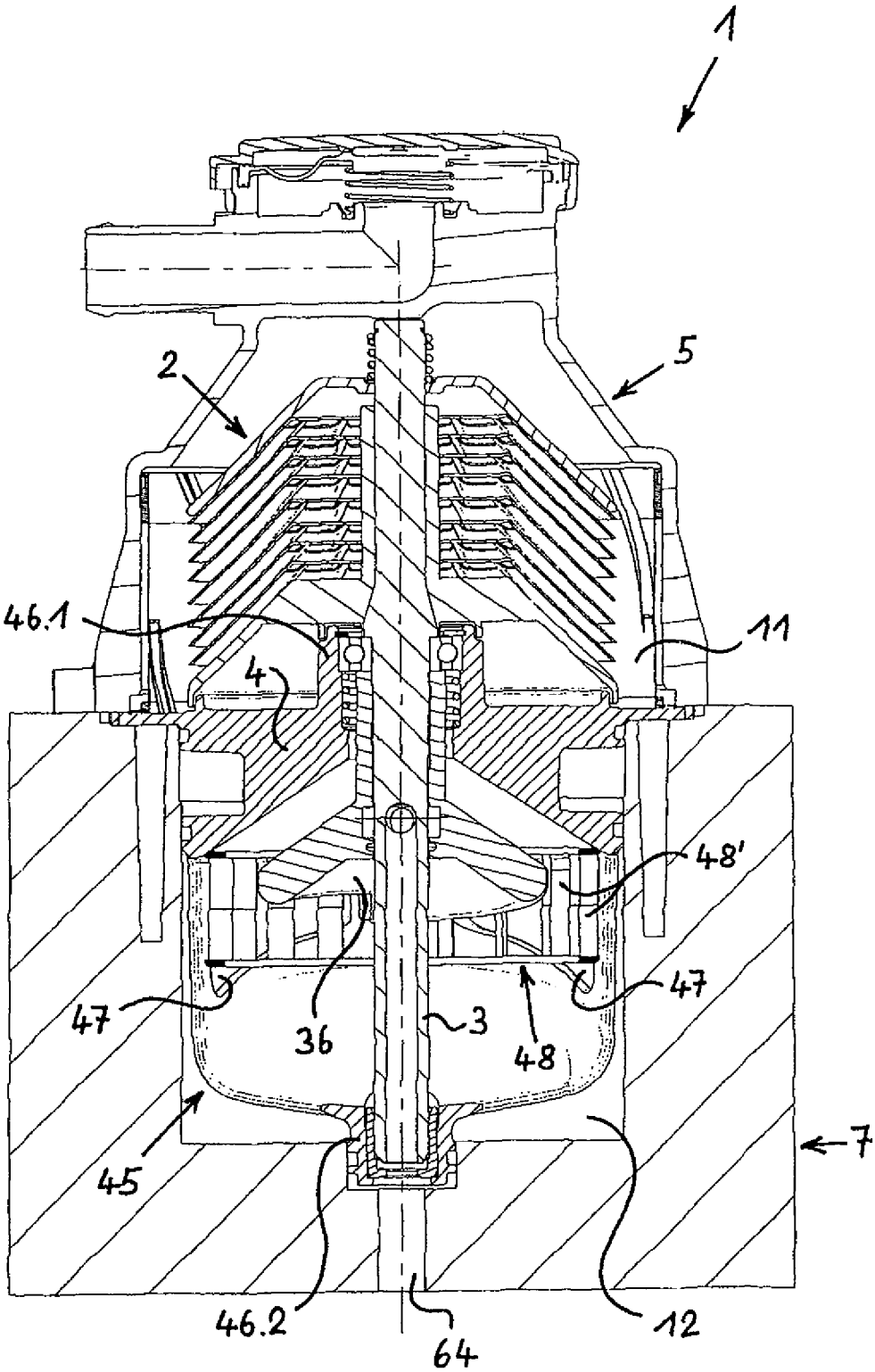
FIG. 20 shows the separator of FIG. 19 in a second longitudinal section rotated by 90° versus FIG. 19.

FIGS. 19 and 20 show another exemplary embodiment of a separator 1, in which FIG. 19 shows the separator 1 in a first longitudinal section and FIG. 20 shows the same separator in a second longitudinal section rotated by 90° versus the other.

It is characteristic for the separator 1 according to FIGS. 19 and 20 that the base 4 which separates the gas purification chamber 11 from the drive chamber 12 is here formed of one piece with a part 45 extending into the drive chamber 12. In its lower end area, this part 45 has a seat 46.2 in which a bottom bearing 33.2 for shaft 3 is received. The bottom bearing 33.2 here is a friction bearing.

An upper bearing 33.1 for shaft 3 is here designed as a rolling bearing and lies in an upper seat 46.1 which is provided on the upper side of the base 4. In this manner, both bearings 33.1 and 33.2 are arranged in the one-piece base 4 which avoids alignment errors in an arrangement of the bearings 33.1 and 33.2 in two different parts of the separator.

The part 45 extends approximately over half the circumference of the drive chamber 12 and is equipped in this course with openings 47 for the lubrication oil—so that the part 45 of the base 4 extending into the drive chamber 12 becomes sufficiently stable, on the one hand; on the other hand, however, so that it does not impair too much the oil discharge of the lubrication oil exiting from the thrust nozzles 38.1, 38.2.

The pressurized lubrication oil for the drive of the centrifugal rotor 2 is here guided through the pressure oil feed 64 into the hollow interior of shaft 3 from where it is passed to the thrust nozzles 38.1, 38.2. The lubrication oil exiting from nozzles 38.1, 38.2 flows off downwardly by gravity through the oil discharge channel 65.

The crankcase ventilation gas to be treated in the separator 1 passes through the crude gas inlet 61—formed within the internal combustion engine 7—into the ring area 42 on the outer circumference of the base 4 and from there upwardly into the gas purification chamber 11 through passage openings not visible here.

To prevent in particular an undesirable oil passage from the drive chamber 12 into the gas purification chamber 11 along a gap space between the shaft 3 and the base 4, the shield ring 39 is mounted with the shaft 3 above the upper bearing 33.1 and the seat 46.1 accommodating it. With the upper seat 46.1, this shield ring 39 forms a noncontact, non-braking gap seal.

In its remaining parts, the separator 1 corresponds with the above described exemplary embodiments; and in terms of the other reference symbols in FIGS. 19 and 20, reference is made to the preceding description of the Figures.

Figure 21:
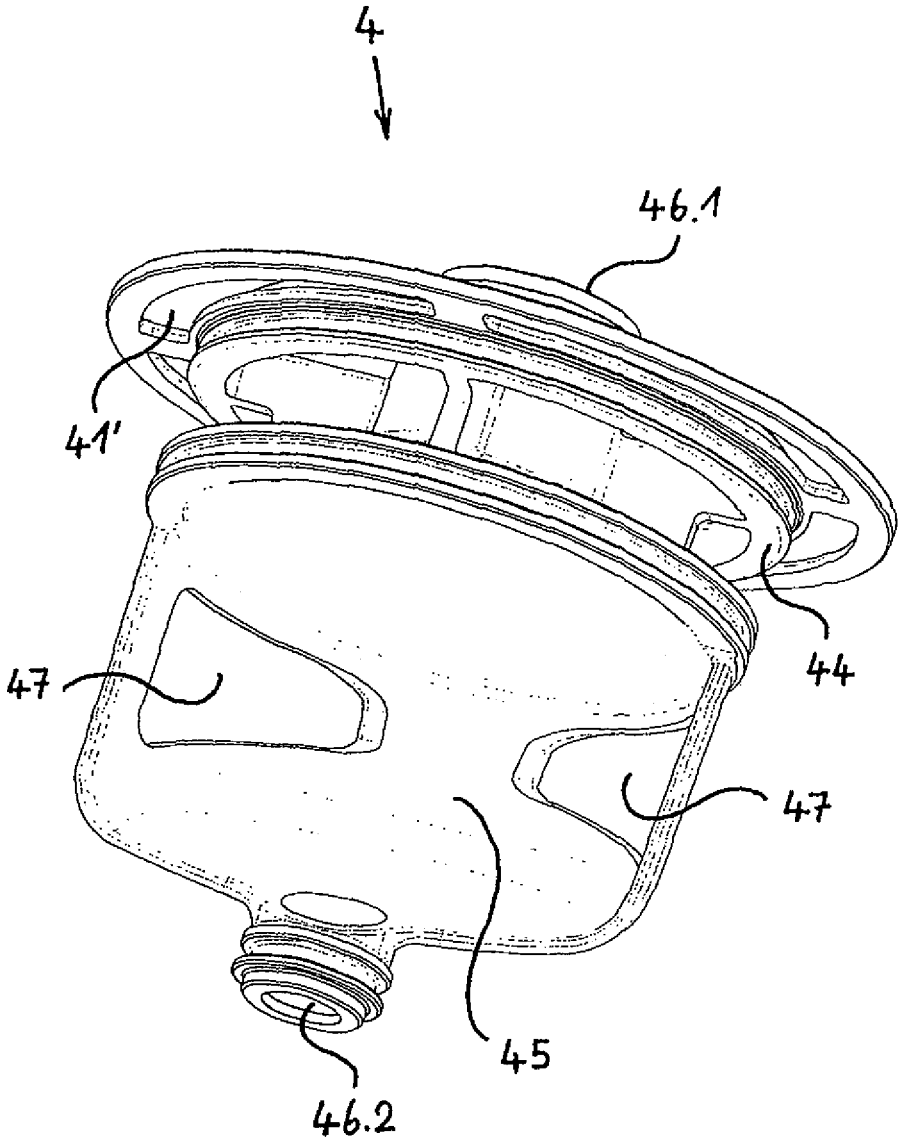
FIG. 21 shows the base of FIGS. 19 and 20 as an individual part in a perspective view.

In FIG. 21, the base 4 of the separator according to FIGS. 19 and 20 is shown as an individual part in a perspective presentation. FIG. 21 illustrates that the base 4 has an upper, essentially disk-shaped part which separates, in the separator's assembled condition, its gas purification chamber from the drive chamber. Near the radially outside circumference of the upper part of the base 4, there are the openings 41' through which the crankcase ventilation gas to be purified passes into the gas purification chamber.

The part 45 extending into the drive chamber extends downwardly from the underside 44 of the base 4. FIG. 21 shows particularly clearly that the part 45, seen in circumferential direction, extends approximately over half the circumference of the base 4. So as not to impair the discharge of the lubrication oil exiting from the thrust nozzles of the rotary drive, the part 45 in its circumferential area has two relatively large, window-like openings 47 for the lubrication oil.

On the very bottom, the part 45 of base 4 has the lower seat 46.2 in which the lower bearing for the shaft is arranged.

The entire base 4 including the part 45 extending downwardly can be manufactured as a one-piece plastic injection molded part or a light-metal-die casting part which enables low-cost mass production.

Figure 22:
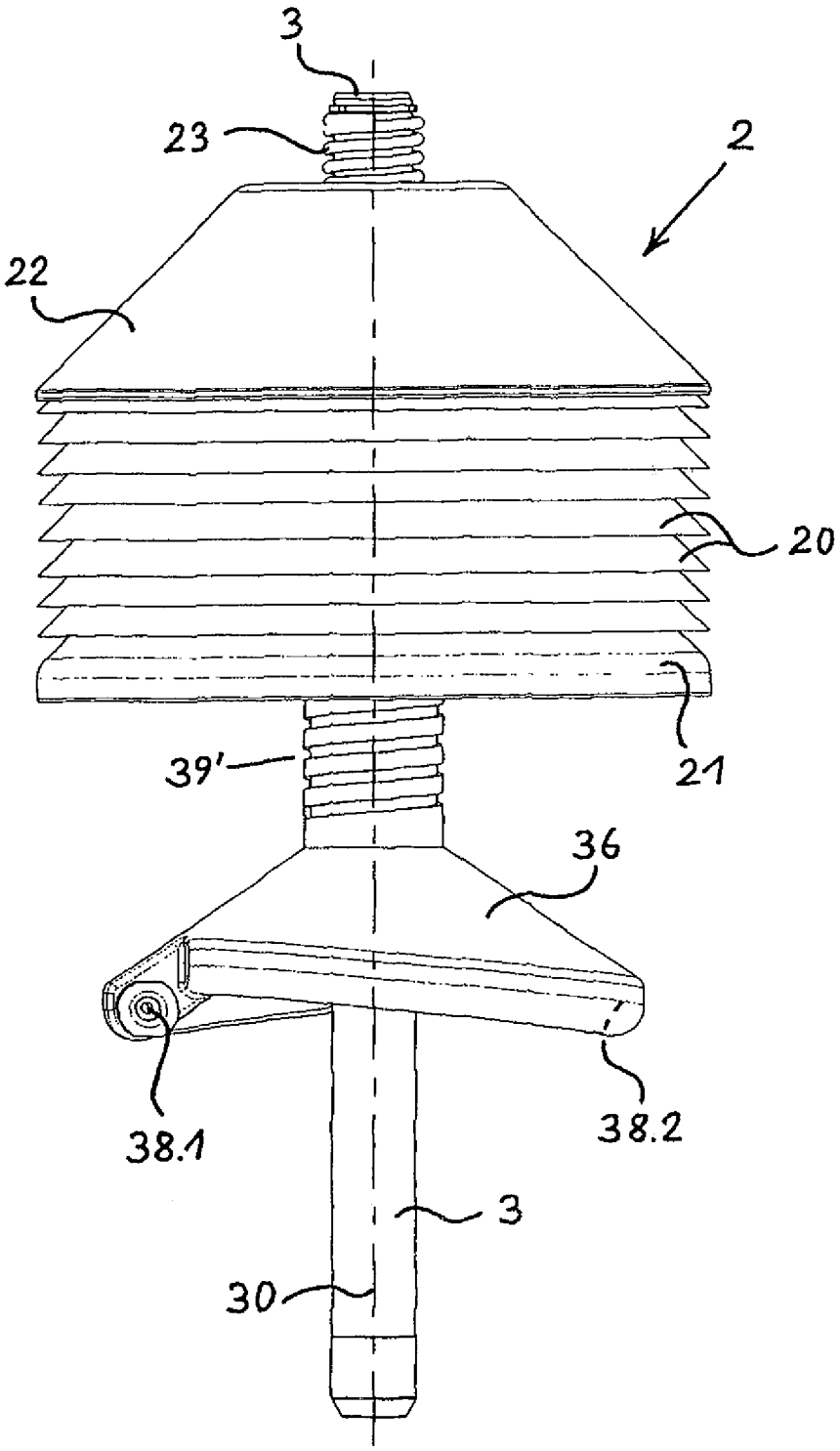
FIG. 22 shows the rotatable part of the separator with shaft, centrifugal separator and rotary drive.

In a side view, FIG. 22 shows as a detail of the separator the centrifugal rotor 2 together with the shaft 3 bearing it. Together with the centrifugal rotor 2, the shaft 3 is rotatable about the rotary axis 30. The centrifugal rotor 2 consists of a plurality of plates 20 which are arranged, torsion-proof on shaft 3, one on top of the other between the stacking bottom 21 and the stacking top 22. By means of spring 23, a force is applied on the upper side of the stacking top 22 and acts in the direction of the stacking bottom 21.

Underneath the centrifugal rotor 2 and at a distance thereto, the nozzle carrier 36 is arranged on the shaft 3. Radially outwardly, the nozzle carrier 36 has the two thrust nozzles of which here only the left thrust nozzle 38.1 is visible, while the other thrust nozzle 38.2 points rearwardly.

Between the stacking bottom 21 and the nozzle carrier 36, the outer circumference of the shaft 3 is designed as a thread seal 39'. In cooperation with a passage bore through the base 4 not shown here, the thread seal 39' effects a frictionless, sufficiently oil- and gas-tight shutoff of drive chamber and gas purification chamber against each other in both directions. This particularly prevents any interfering passage of lubrication oil from the drive chamber located on the bottom into the gas purification chamber located on the top.

Figure 23:
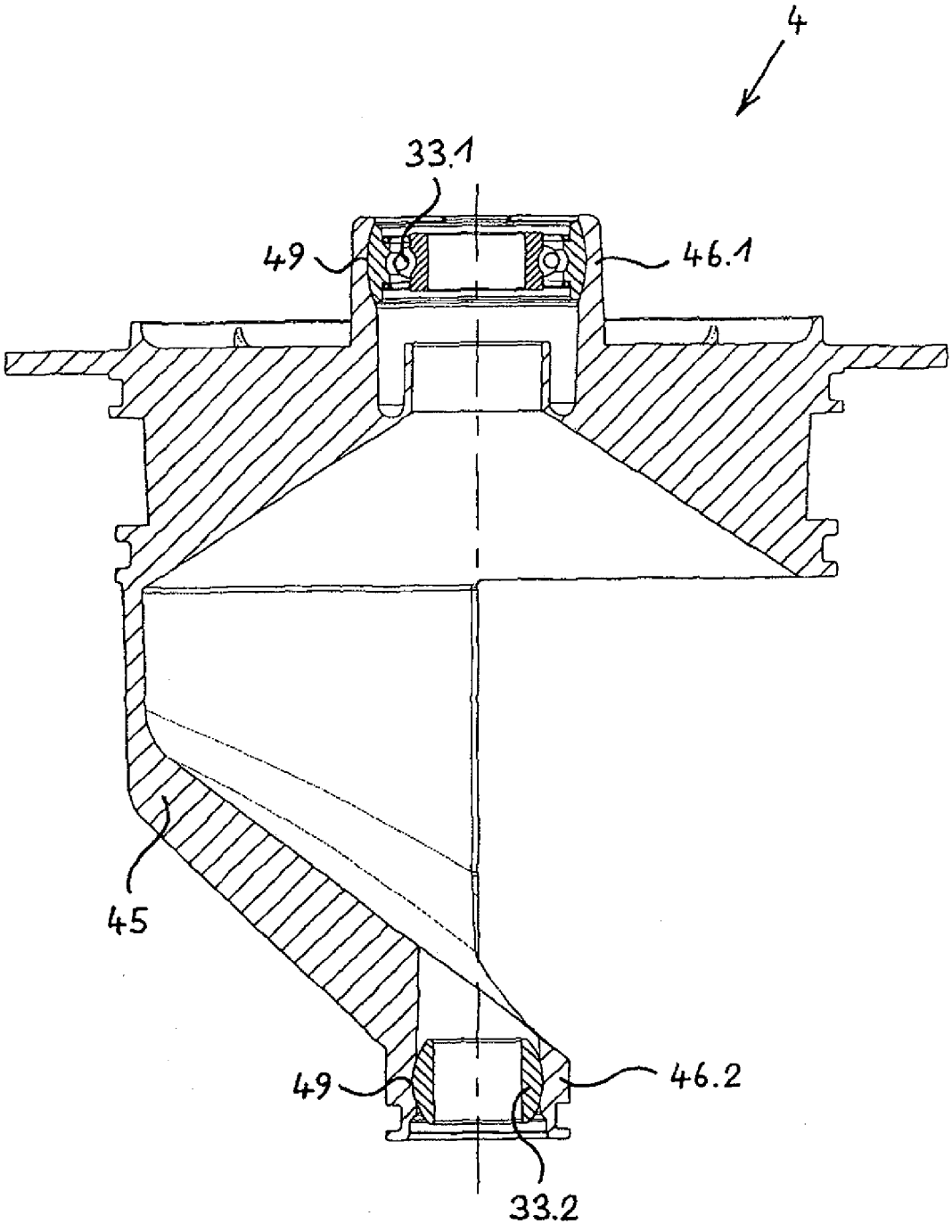
FIG. 23 shows the base in another embodiment with two bearings, in longitudinal section.

FIG. 23 presents, in longitudinal section, a base 4 with the part 45 extending into the drive chamber. In its upper part, base 4 bears in seat 46.1 the first, upper bearing 33.1 for the rotor's shaft not presented here. In the lower area of part 45, the second, lower bearing 33.2 for the shaft is arranged in the seat 46.2 there provided.

To prevent sluggishness of the shaft due to alignment errors of the two bearings 33.1 and 33.2, the two bearings 33.1 and 33.2 as well as the appropriate seats 46.1 and 46.2 are here designed as or, respectively, with spherical caps 49. Due to this design as spherical caps 49, the two bearings 33.1 and 33.2 can align themselves without constraint in the longitudinal direction of the shaft, even if possible movements of the seats 46.1 and 46.2 relative to each other may occur in operation. Reason for such movements and alignment errors can be, for example, temperature changes or errors in manufacturing. Due to the use of spherical caps 49, such influences have no negative effect on the smooth running of the bearing of the shaft in both bearings 33.1 and 33.2. As FIG. 23 illustrates, in the example of the base 4 there shown, the bearings 33.1 and 33.2 are directly inserted into the associated seats 46.1 and 46.2 which is expedient with a base 4 of metal, particularly a light metal, such as aluminum.

Figure 24:
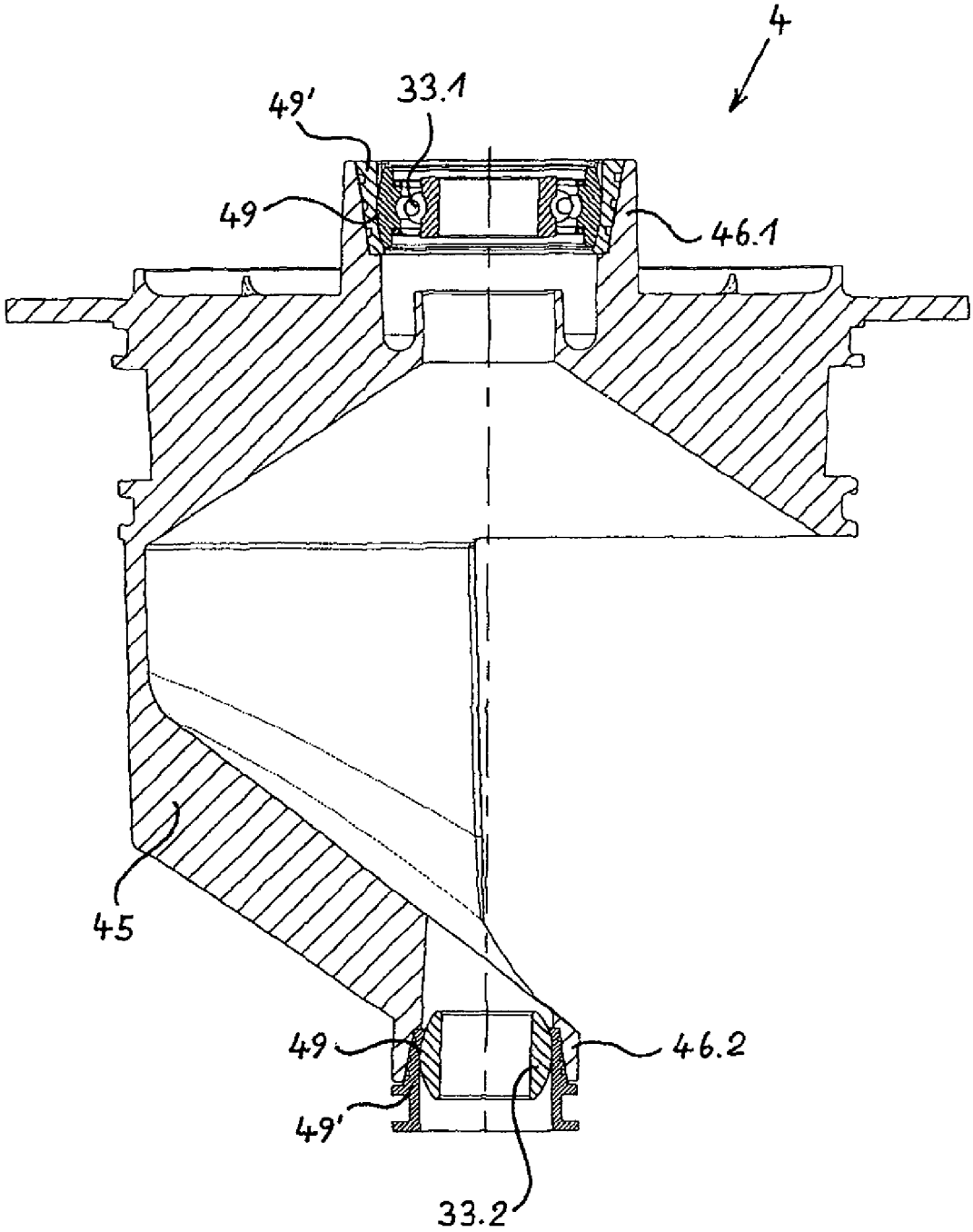
FIG. 24 shows the base in a modified embodiment with two bearings, in longitudinal section.

FIG. 24 shows a modification of the base 4 from FIG. 23. In its design, the base 4 according to FIG. 24 essentially corresponds with the base 4 in FIG. 23, thus, it also has the part 45 extending into the drive chamber.

Also present are the two seats 46.1 and 46.2 for the two bearings 33.1 and 33.2. A spherical cap insert 49' is arranged between the pertinent bearing 33.1 or, respectively, 33.2 and the associated seat 46.1 and 46.2, respectively; said insert form one spherical cap 49 each on its inner circumference together with the correspondingly formed outer circumference of the pertinent bearing 33.1 or 33.2, respectively. Thus, here to, an automatically precisely aligning alignment is possible without constraint for the bearings 33.1 and 33.2 according to the course of the shaft not presented here. The spherical cap inserts 49' themselves preferably consist of metal while the remaining base 4 may be of a plastic material.

Figure 25:
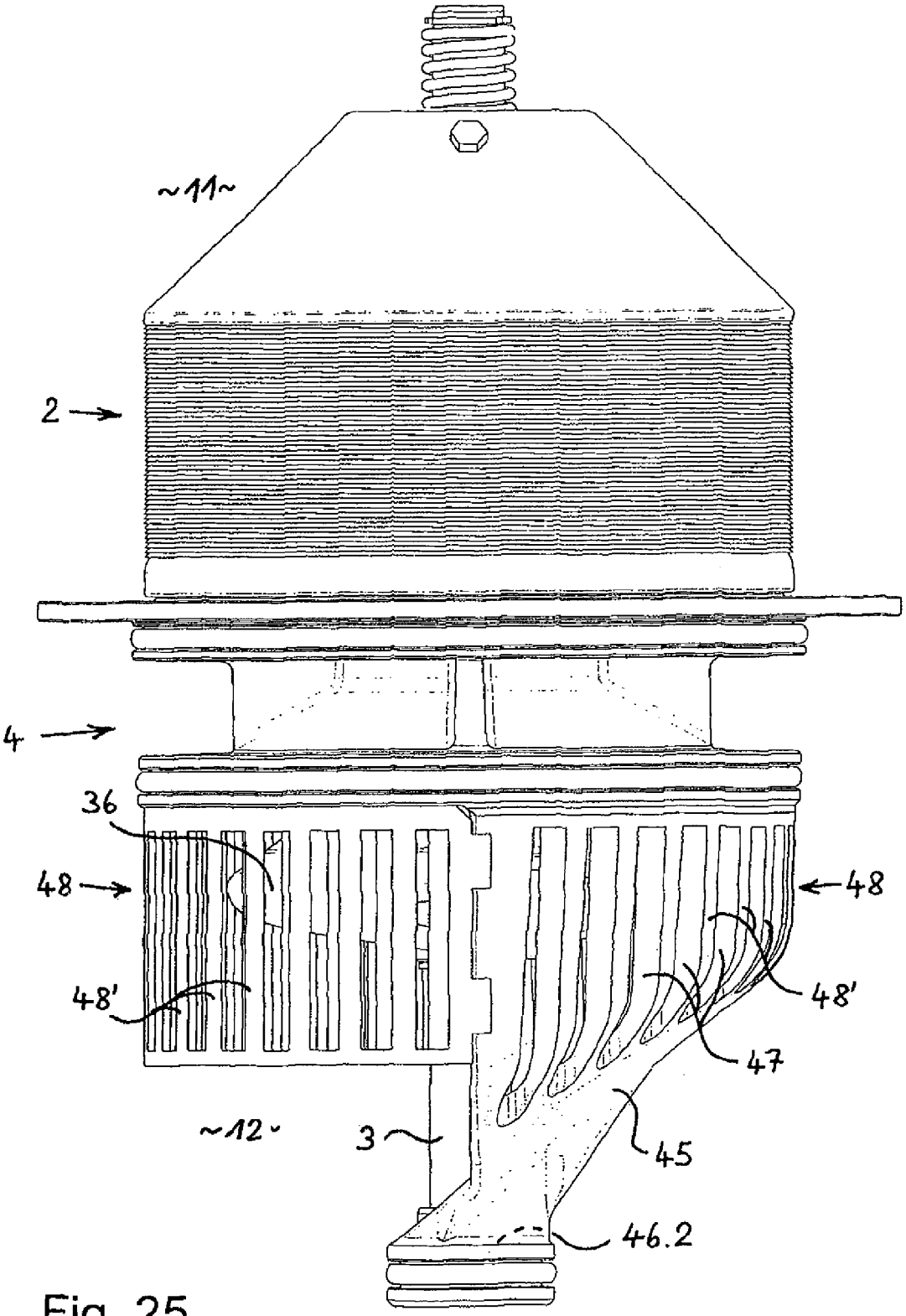
FIG. 25 shows the base in another embodiment with the centrifugal rotor, with a nozzle carrier and with an oil retainer, in a side view.

FIG. 25 shows on the bottom one embodiment of the base 4 together with the part 45 extending into the drive chamber 12; and on the top, a centrifugal rotor 2 which is arranged in the gas purification chamber 11.

In the drive chamber 12, an oil retainer 48 is arranged which surrounds the nozzle carrier 36 which is connected torsion-proof with the shaft 3 and sets the rotor 2 in rotation. In its right half of FIG. 25, the oil retainer 48 is here designed as one piece with the base 4, more precisely with its part 45. Since the part 45 only extends over approximately half the circumference of the base 4, in the other half, i.e. in the left half of FIG. 25, the oil retainer 48 is formed by a separate part which is connected in such a way with the remaining base 4 that the circumferential oil retainer 48 results.

Here again, the oil retainer 48 has lamellae 48' which form openings 47 between them and which are obliquely aligned, extending vertically and in parallel to the shaft 3. Corresponding with the oblique alignment of the lamellae 48', the openings 47 are designed with an oblique course. This oblique course is directed such that an oil jet exiting from the thrust nozzles of the nozzle carrier 36 can pass largely unhindered between the lamellae 48', but an oil jet which is reflected from radially outside in the direction of the lamellae 48' is largely stopped by the lamellae 48'. Any undesirable deceleration of the nozzle carrier 36 by reflected oil splashes is thus prevented. The reflection surface for the oil forms an inner circumferential surface of the drive chamber 12 which is not presented on its own in FIG. 25; but as a rule, it is available to delimit the drive chamber 12 from the external environment.

On the very bottom of FIG. 25, the lower seat 46.2 is still visible on the lower end of the part 45 of base 4.

Figure 26:
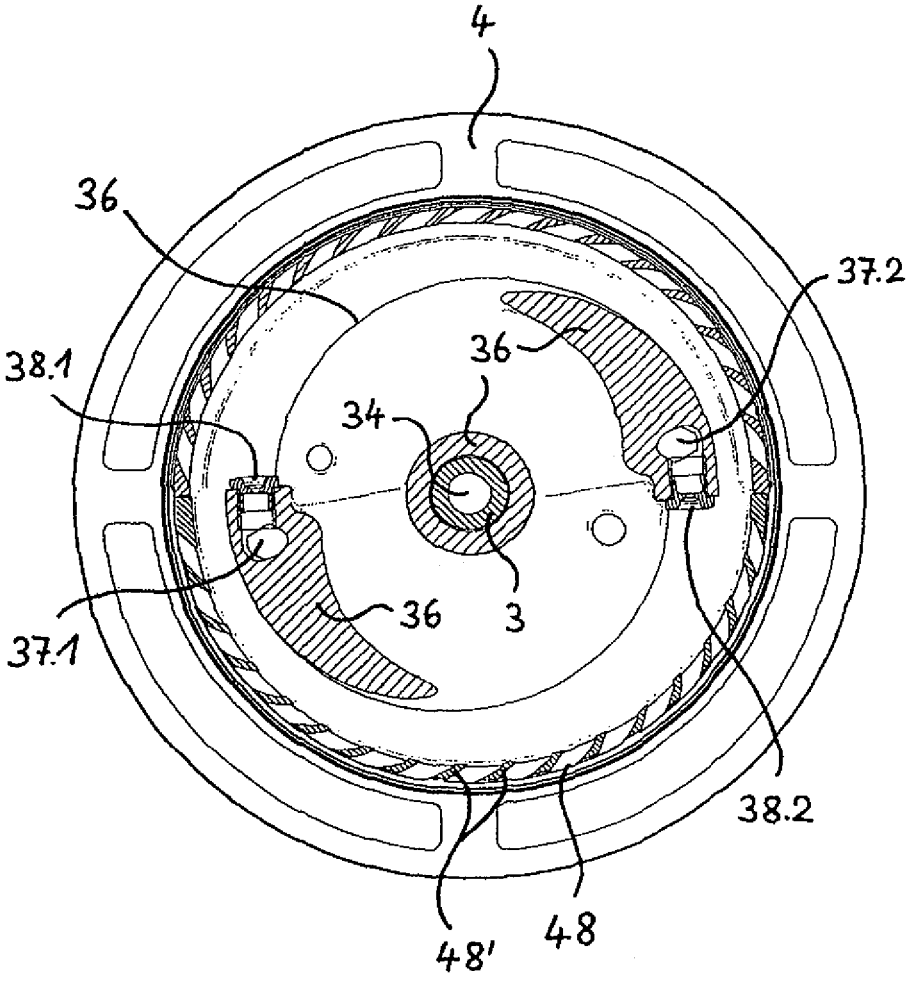
FIG. 26 shows the base and the nozzle carrier of FIG. 25 in a bottom view, partly in cross-section.

FIG. 26 shows a bottom view, partly in cross-section, onto the base 4 and the nozzle carrier 36 of FIG. 25. The shaft 3 is cut in the center of FIG. 26. Radially outside thereof, an inner area of the nozzle carrier 36 is cut. Further outside in radial direction, the two thrust nozzles 38.1 and 38.2 are provided for the drive of the shaft 3. Pressurized lubrication oil is supplied to the thrust nozzles 38.1 and 38.2 through the branch channels 37.1 and 37.2. These branch channels 37.1 and 37.2 are in a flow connection with the central hollow channel 34 on the inside of shaft 3 in a manner not visible here.

The oil retainer 48 with its lamellae 48' is arranged radially outside from the nozzle carrier 36. FIG. 26 illustrates that two neighboring lamellae 48' each form a spacing, the course of which is adjusted to the course of an oil jet exiting from the thrust nozzles 38.1 and 38.2. In this manner, oil jets from the thrust nozzles 38.1 and 38.2 can flow largely unhindered through the oil retainer 48 from radially inside to radially outside; however, a reverse flow of reflected oil splashes from radially outside to radially inside through the oil retainer 48 is rendered more difficult since, in this reverse flow direction, the lamellae 48' form a shield. Thus, it will prevent any undesirable deceleration of the nozzle carrier 36 and thus of the shaft 3 with the centrifugal rotor.

Figure 27:
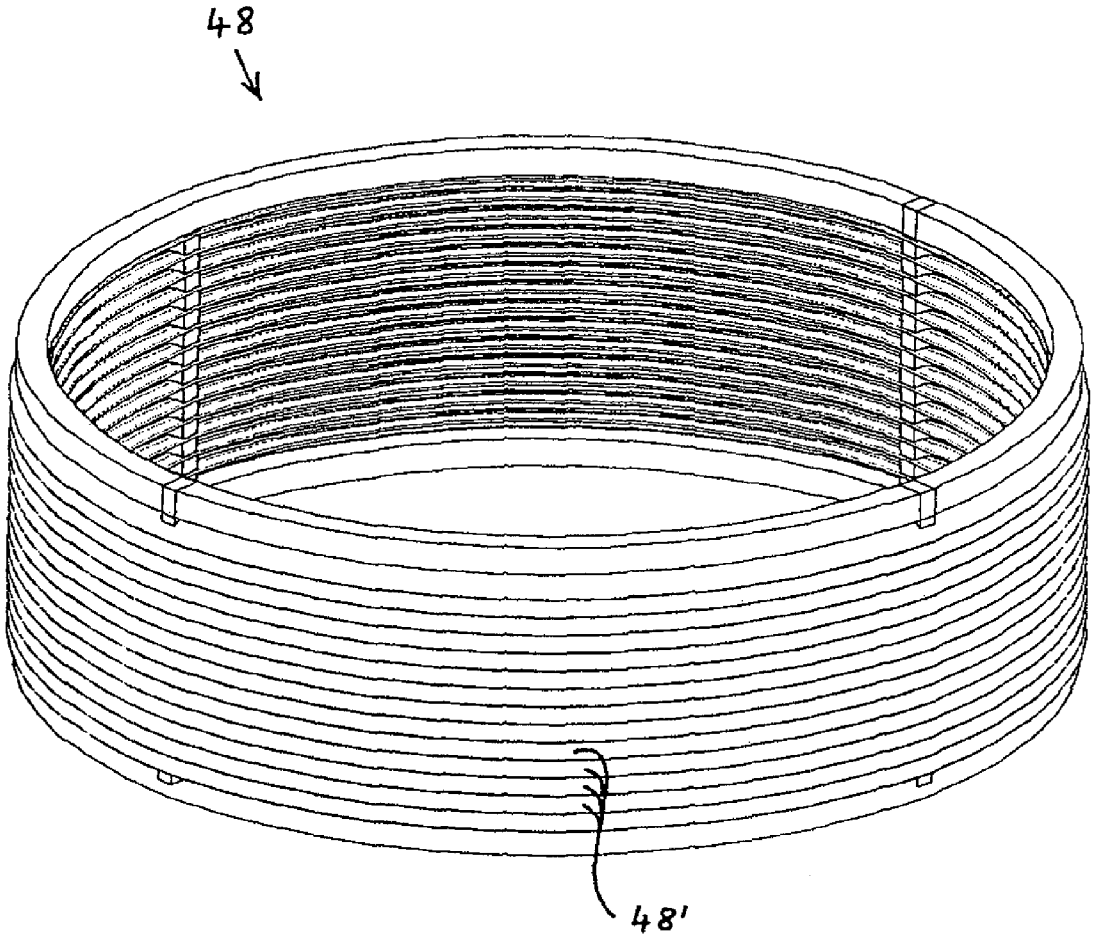
FIGS. 27-29 shows the oil retainer in another embodiment in different presentations.
Figure 28:
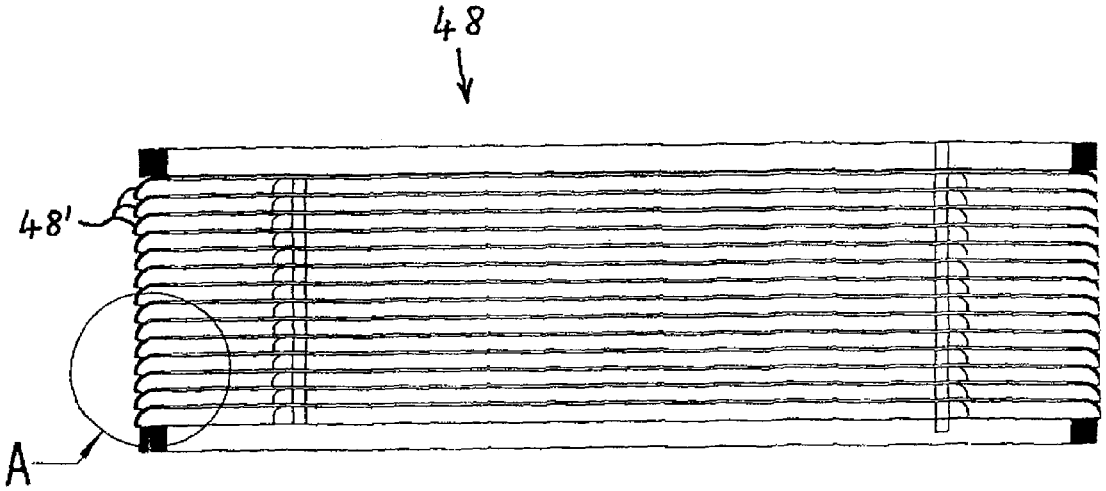
Figure 29:
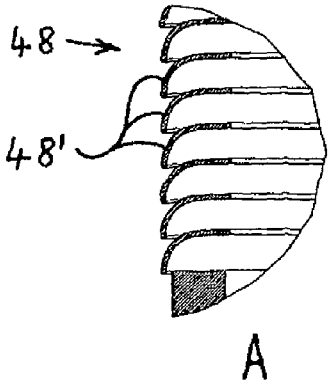

FIGS. 27 to 29 show the oil retainer 48 in another embodiment in different presentations, namely in FIG. 27 in a view obliquely from above, in FIG. 28 in a side view and in FIG. 29 in an enlarged detail "A" of FIG. 28. The oil retainer 48 here has a plurality of lamellae 48' which are arranged spaced apart from each other seen in axial direction and which extend in circumferential direction concentrically to the shaft 3 here not presented, with one surface plane each of the lamellae 48' extending obliquely to the radial plane of the oil retainer 48. Here, the surface plane of the lamellae 48' e.g. each forms an angle of a maximum of 45° to the radial plane of the oil retainer 48.

According to FIGS. 28 and 29, the lamellae 48' can also be bent as seen in cross-section.

With the lamellae 48', an oil jet from the thrust nozzle is deflected downwardly and thus away from moving drive parts.

Figure 30:
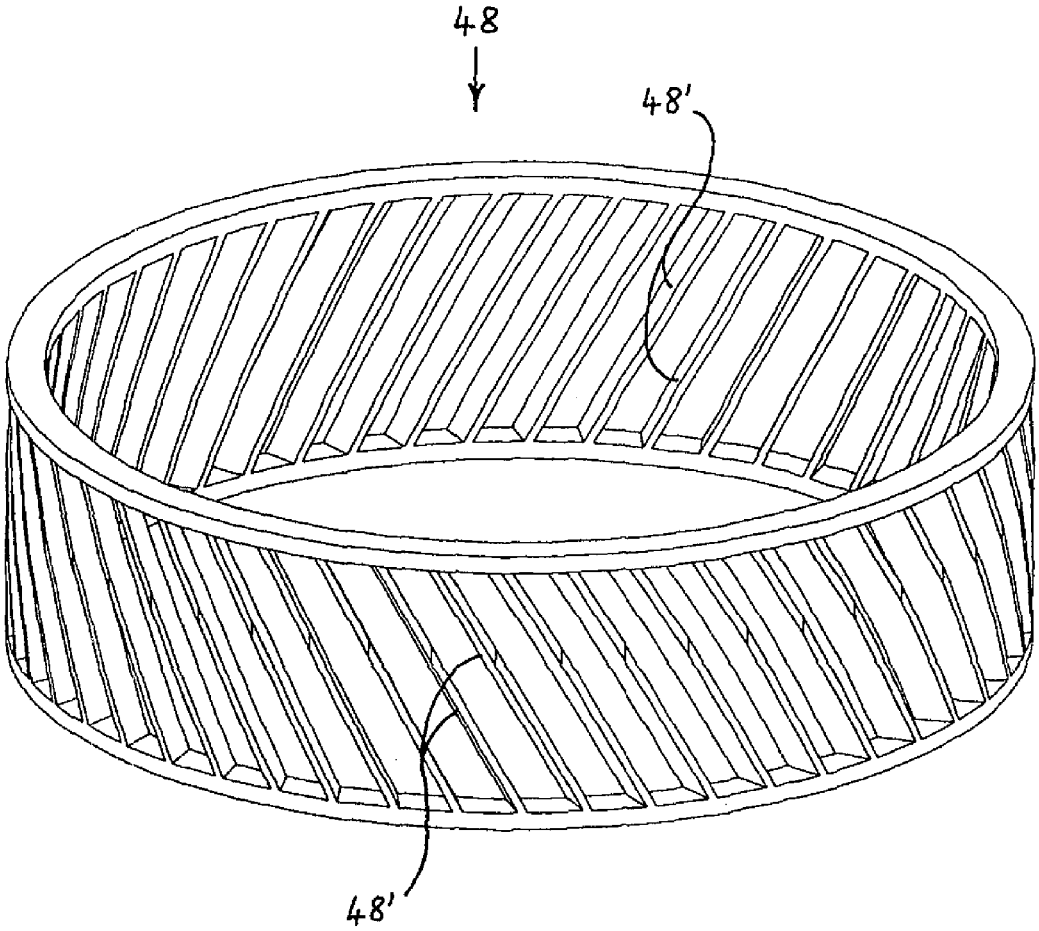
FIGS. 30-32 shows the oil retainer in a modified embodiment in different presentations.
Figure 31:
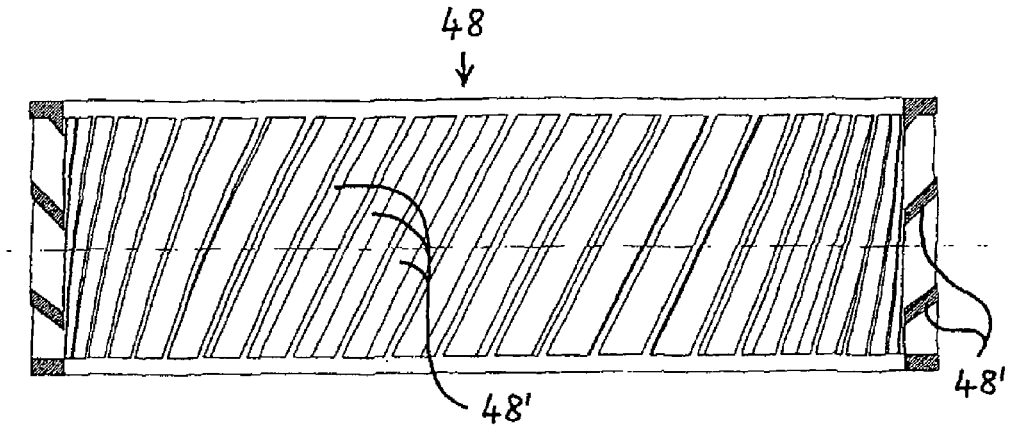
Figure 32:
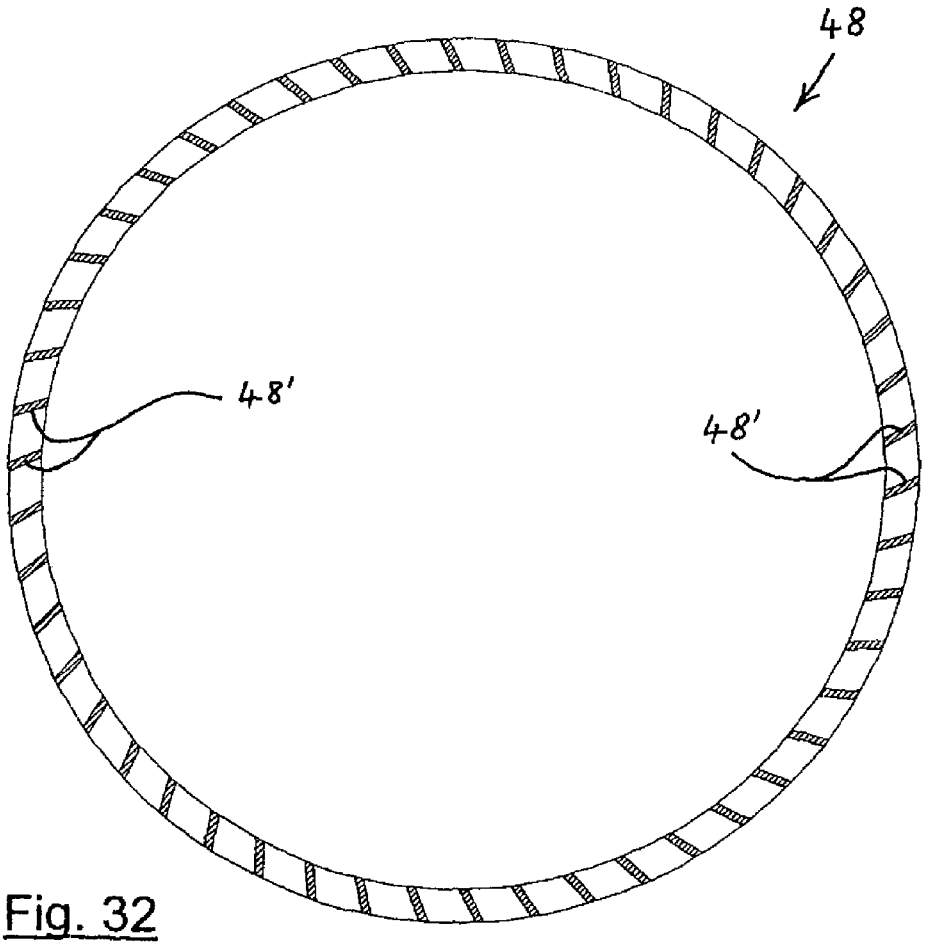

FIGS. 30 to 32 show the oil retainer 48 in a modified embodiment in various presentations, namely in FIG. 30 in a view obliquely from above, in FIG. 31 in longitudinal section, and in FIG. 32 in cross-section.

FIGS. 30 and 31 show that the oil retainer 48 here has a plurality of lamellae 48' which are arranged spaced apart from each other, as well as obliquely in an intermediate direction between a course pointing in parallel to the shaft 3 and concentrically to the shaft 3, with the shaft 3 here also not being shown. In this case, a longitudinal direction of the lamellae 48' each forms an angle of between 30° and 60° to the axial direction of the oil retainer 48. FIG. 32 shows that the lamellae, with their surface plane, furthermore form an angle to the radial direction.

With these lamellae 48', an oil jet can be deflected in two spatial directions to particularly safely guide it away and keep it far away from the moving drive parts.

Figure 33:
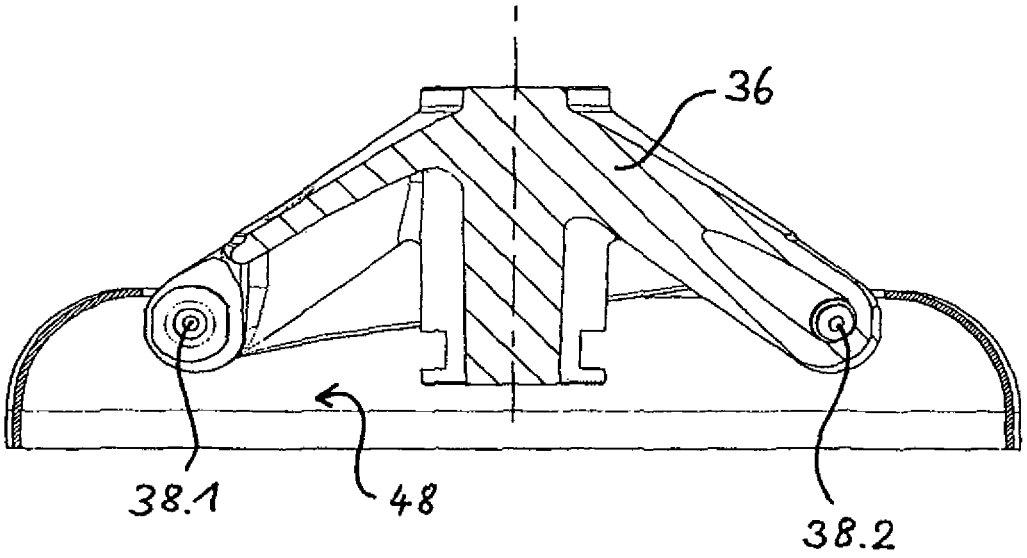
FIG. 33 shows the oil retainer in the form of a bell in longitudinal section.

FIG. 33 shows the oil retainer 48 in the shape of a bell in longitudinal section. Due to the bell shape, the oil jets exiting from the thrust nozzles 38.1, 38.2 steadily deflect downwardly and thus away from the rotating nozzle carrier 36.

Figure 34:
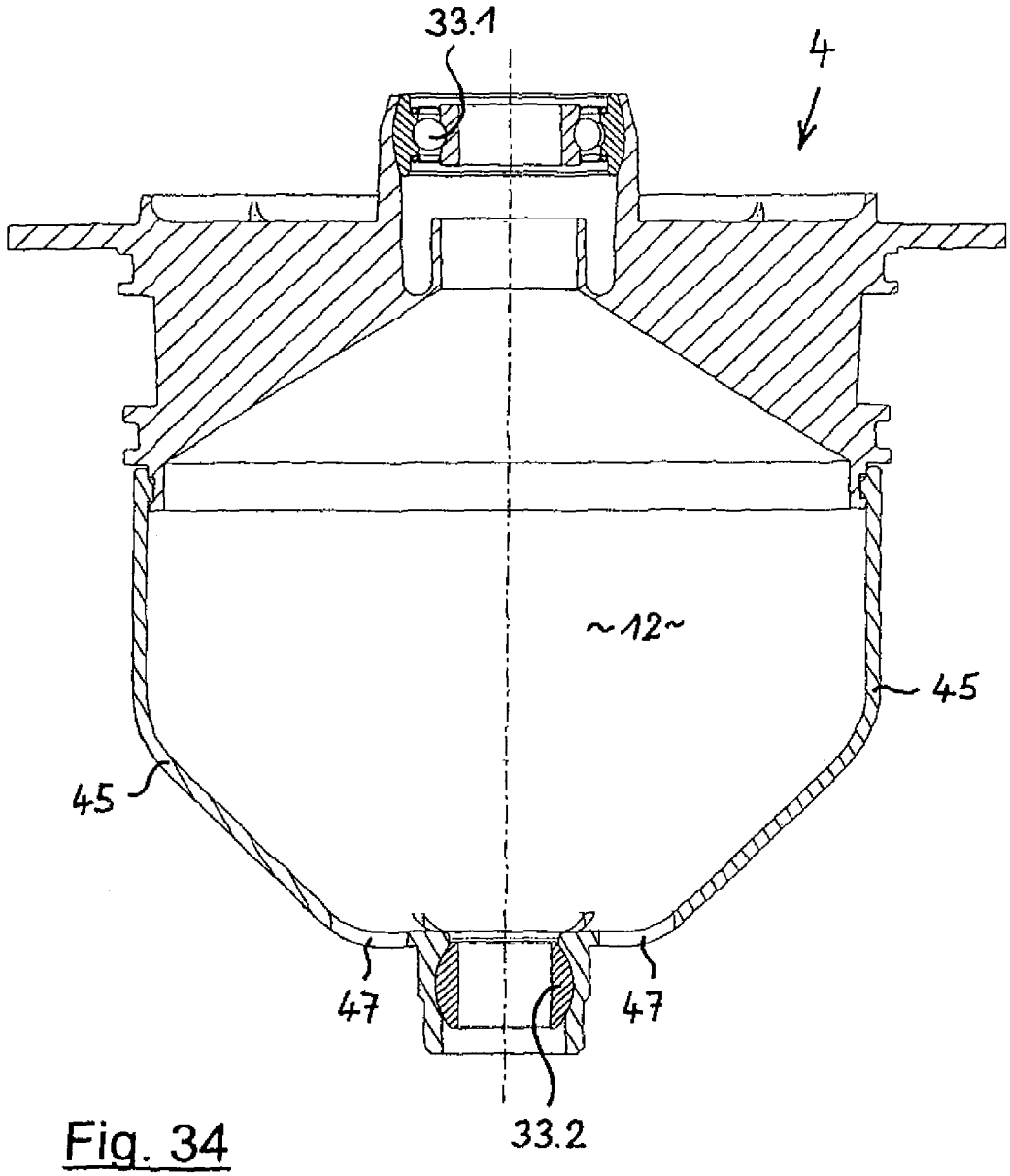
FIG. 34 shows the base with the part extending into the drive chamber and with two bearings, in longitudinal section.

FIG. 34 shows the base 4 with the part 45 extending in the drive chamber 12 and with two bearings 33.1, 33.2 in longitudinal section in another embodiment. It is here characteristic that the part 45 is first manufactured as a separate, approximately cup-shaped individual part and then connected with the remaining base 4. The connection here is e.g. a clipped, or welded, or adhesive joint.

On the bottom in part 45, openings 47 are provided radially outside of bearing 33.2 for the draining oil. Alternatively or additionally, openings may also be provided in the circumferential area of part 45, e.g. in the form as with the oil retainer 48 described above.

The embodiment according to FIG. 34 simplifies the assembly of bearings 33.1, 33.2 and of the shaft 3 with the nozzle carrier 36 which are not presented in FIG. 34.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A separator for separating oil mist from crankcase ventilation gas of an internal combustion engine, with a gas purification chamber inside which a rotatably mounted centrifugal rotor is arranged, the gas purification chamber having a crude gas inlet, a pure gas outlet, and an oil outlet, the crankcase ventilation gas is conducted into a radially internal zone of the centrifugal rotor via the crude gas inlet, while pure gas liberated from oil mist is discharged from the gas purification chamber via the pure gas outlet, and oil separated from the gas is discharged from the gas purification chamber via the oil outlet, the separator comprises a rotary drive for the centrifugal rotor, the rotary drive being arranged in a drive chamber of the separator, the drive chamber being separately arranged from the gas purification chamber, and the rotary drive is operated using pressurized lubrication oil of the internal combustion engine and is connected to the centrifugal rotor by means of a shaft extending from the drive chamber into the gas purification chamber, the rotary drive is formed by at least one thrust nozzle which is connected to the shaft and to which the pressurized lubrication oil of the internal combustion engine can be fed, wherein at least one part of a base that forms the separation between the gas purification chamber and the drive chamber extends into the drive chamber, the one part of the base being fitted with a seat for a bearing of the shaft, the bearing being located at a distance from the centrifugal rotor, wherein two bearings bearing the shaft are spaced apart from each other and arranged in the base.

2. A separator according to claim 1, wherein the base including two seats for the bearings of the shaft is formed as a one-piece pressure die cast or injection molded part.

3. A separator according to claim 2, wherein the seats or the bearings are designed as or with spherical caps which are alignable in the longitudinal direction of the shaft.

4. A separator according to claim 1, wherein the base, including two seats for the bearings of the shaft, is formed as a two or more-piece or multiple pressure die cast or injection molded part, with these two or more parts being connected with each other.

5. A functional module of an internal combustion engine, comprising a separator according to claim 1, wherein the separator is combined with at least one other component of an associated internal combustion engine.

6. A separator for separating oil mist from crankcase ventilation gas of an internal combustion engine, with a gas purification chamber inside which a rotatably mounted centrifugal rotor is arranged, the gas purification chamber having a crude gas inlet, a pure gas outlet, and an oil outlet, the crankcase ventilation gas is conducted into a radially internal zone of the centrifugal rotor via the crude gas inlet, while pure gas liberated from oil mist is discharged from the gas purification chamber via the pure gas outlet, and oil separated from the gas is discharged from the gas purification chamber via the oil outlet, the separator comprises a rotary drive for the centrifugal rotor, the rotary drive being arranged in a drive chamber of the separator, the drive chamber being separately arranged from the gas purification chamber, and the rotary drive is operated using pressurized lubrication oil of the internal combustion engine and is connected to the centrifugal rotor by means of a shaft extending from the drive chamber into the gas purification chamber, the rotary drive is formed by at least one thrust nozzle which is connected to the shaft and to which the pressurized lubrication oil of the internal combustion engine can be fed, wherein at least one part of a base that forms the separation between the gas purification chamber and the drive chamber extends into the drive chamber, the one part of the base being fitted with a seat for a bearing of the shaft, the bearing being located at a distance from the centrifugal rotor, wherein the base, apart from the part extending into the drive chamber, is essentially plate-shaped and a bearing of the shaft being closest to the centrifugal rotor is arranged in the plate-shaped part of the base.

7. A separator for separating oil mist from crankcase ventilation gas of an internal combustion engine, with a gas purification chamber inside which a rotatably mounted centrifugal rotor is arranged, the gas purification chamber having a crude gas inlet, a pure gas outlet, and an oil outlet, the crankcase ventilation gas is conducted into a radially internal zone of the centrifugal rotor via the crude gas inlet, while pure gas liberated from oil mist is discharged from the gas purification chamber via the pure gas outlet, and oil separated from the gas is discharged from the gas purification chamber via the oil outlet, the separator comprises a rotary drive for the centrifugal rotor, the rotary drive being arranged in a drive chamber of the separator, the drive chamber being separately arranged from the gas purification chamber, and the rotary drive is operated using pressurized lubrication oil of the internal combustion engine and is connected to the centrifugal rotor by means of a shaft extending from the drive chamber into the gas purification chamber, the rotary drive is formed by at least one thrust nozzle which is connected to the shaft and to which the pressurized lubrication oil of the internal combustion engine can be fed, wherein at least one part of a base that forms the separation between the gas purification chamber and the drive chamber extends into the drive chamber, the one part of the base being fitted with a seat for a bearing of the shaft, the bearing being located at a distance from the centrifugal rotor, wherein the base and the shaft form a noncontact gap or thread seal.

8. A separator for separating oil mist from crankcase ventilation gas of an internal combustion engine, with a gas purification chamber inside which a rotatably mounted centrifugal rotor is arranged, the gas purification chamber having a crude gas inlet, a pure gas outlet, and an oil outlet, the crankcase ventilation gas is conducted into a radially internal zone of the centrifugal rotor via the crude gas inlet, while pure gas liberated from oil mist is discharged from the gas purification chamber via the pure gas outlet, and oil separated from the gas is discharged from the gas purification chamber via the oil outlet, the separator comprises a rotary drive for the centrifugal rotor, the rotary drive being arranged in a drive chamber of the separator, the drive chamber being separately arranged from the gas purification chamber, and the rotary drive is operated using pressurized lubrication oil of the internal combustion engine and is connected to the centrifugal rotor by means of a shaft extending from the drive chamber into the gas purification chamber, the rotary drive is formed by at least one thrust nozzle which is connected to the shaft and to which the pressurized lubrication oil of the internal combustion engine can be fed, wherein at least one part of a base that forms the separation between the gas purification chamber and the drive chamber extends into the drive chamber, the one part of the base being fitted with a seat for a bearing of the shaft, the bearing being located at a distance from the centrifugal rotor, wherein the rotary drive is formed by a pair of two thrust nozzles uniformly spaced in circumferential direction and wherein a crankcase pressure regulating valve is built into or onto the cover, with the pure gas outlet extending through the crankcase pressure regulating valve.

9. A separator according to claim 8, wherein at least one part of a housing of the pressure regulating valve is formed as one piece with the cover.

10. A separator for separating oil mist from crankcase ventilation gas of an internal combustion engine, with a gas purification chamber inside which a rotatably mounted centrifugal rotor is arranged, the gas purification chamber having a crude gas inlet, a pure gas outlet, and an oil outlet, the crankcase ventilation gas is conducted into a radially internal zone of the centrifugal rotor via the crude gas inlet, while pure gas liberated from oil mist is discharged from the gas purification chamber via the pure gas outlet, and oil separated from the gas is discharged from the gas purification chamber via the oil outlet, the separator comprises a rotary drive for the centrifugal rotor, the rotary drive being arranged in a drive chamber of the separator, the drive chamber being separately arranged from the gas purification chamber, and the rotary drive is operated using pressurized lubrication oil of the internal combustion engine and is connected to the centrifugal rotor by means of a shaft extending from the drive chamber into the gas purification chamber, the rotary drive is formed by at least one thrust nozzle which is connected to the shaft and to which the pressurized lubrication oil of the internal combustion engine can be fed, wherein at least one part of a base that forms the separation between the gas purification chamber and the drive chamber extends into the drive chamber, the one part of the base being fitted with a seat for a bearing of the shaft, the bearing being located at a distance from the centrifugal rotor, wherein the drive chamber, radially outside from a circular path of the at least one thrust nozzle, an oil retainer is arranged which deflects lubrication oil exiting from the thrust nozzle from moving parts of the rotary drive.

11. A separator according to claim 10, wherein the oil retainer comprises a plurality of lamellae which, seen in circumferential direction, are arranged spaced apart from each other and extend axially in parallel with the shaft, with one surface level of the lamellae extending transversely to the radial direction of the oil retainer.

12. A separator according to claim 11, wherein the surface level of the lamellae forms each an angle of between 0° and 45° to one jet direction of a lubrication oil jet exiting from the thrust nozzle and flowing against the lamellae.

13. A separator according to claim 10, wherein the oil retainer comprises a plurality of lamellae which, seen in axial direction, are arranged spaced apart from each other and extend concentrically to the shaft in circumferential direction, with one surface level of each of the lamellae extending transversely to the radial level of the oil retainer.

14. A separator according to claim 13, wherein the surface level of each of the lamellae forms an angle of a maximum of 45° to the radial level of the oil retainer.

15. A separator according to claim 10, wherein the oil retainer comprises a plurality of lamellae which are arranged spaced apart from each other as well as transversely in an intermediate direction between a path extending parallel to the shaft and concentrically to the shaft.

16. A separator according to claim 15, wherein one longitudinal direction of each of the lamellae forms an angle of between 30° and 60° to the axial direction of the oil retainer.

17. A separator according to claim 10, wherein the oil retainer is bell-shaped, with one open side of the oil retainer showing in a direction facing away from the centrifugal rotor.

18. A separator according to claim 10, wherein at least one part of the oil retainer is formed as one piece with the base.

19. A separator for separating oil mist from crankcase ventilation gas of an internal combustion engine, with a gas purification chamber inside which a rotatably mounted centrifugal rotor is arranged, the gas purification chamber having a crude gas inlet, a pure gas outlet, and an oil outlet, the crankcase ventilation gas is conducted into a radially internal zone of the centrifugal rotor via the crude gas inlet, while pure gas liberated from oil mist is discharged from the gas purification chamber via the pure gas outlet, and oil separated from the gas is discharged from the gas purification chamber via the oil outlet, the separator comprises a rotary drive for the centrifugal rotor, the rotary drive being arranged in a drive chamber of the separator, the drive chamber being separately arranged from the gas purification chamber, and the rotary drive is operated using pressurized lubrication oil of the internal combustion engine and is connected to the centrifugal rotor by means of a shaft extending from the drive chamber into the gas purification chamber, the rotary drive is formed by at least one thrust nozzle which is connected to the shaft and to which the pressurized lubrication oil of the internal combustion engine can be fed, wherein at least one part of a base that forms the separation between the gas purification chamber and the drive chamber extends into the drive chamber, the one part of the base being fitted with a seat for a bearing of the shaft, the bearing being located at a distance from the centrifugal rotor, wherein it is modularly produced by means of a modular system in one of different designs and sizes, wherein a uniform base and/or a uniform rotary drive can be combined with one of a plurality of different centrifugal rotors and/or with one of a plurality of different covers.

20. An internal combustion engine with a separator for separating oil mist from crankcase ventilation gas of an internal combustion engine, with a gas purification chamber inside which a rotatably mounted centrifugal rotor is arranged, the gas purification chamber having a crude gas inlet, a pure gas outlet, and an oil outlet, the crankcase ventilation gas is conducted into a radially internal zone of the centrifugal rotor via the crude gas inlet, while pure gas liberated from oil mist is discharged from the gas purification chamber via the pure gas outlet, and oil separated from the gas is discharged from the gas purification chamber via the oil outlet, the separator comprises a rotary drive for the centrifugal rotor, the rotary drive being arranged in a drive chamber of the separator, the drive chamber being separately arranged from the gas purification chamber, and the rotary drive is operated using pressurized lubrication oil of the internal combustion engine and is connected to the centrifugal rotor by means of a shaft extending from the drive chamber into the gas purification chamber, the rotary drive is formed by at least one thrust nozzle which is connected to the shaft and to which the pressurized lubrication oil of the internal combustion engine can be fed, wherein at least one part of a base that forms the separation between the gas purification chamber and the drive chamber extends into the drive chamber, the one part of the base being fitted with a seat for a bearing of the shaft, the bearing being located at a distance from the centrifugal rotor, wherein a mounting flange is provided on the internal combustion engine on which the separator is mounted by creating flow connections.

21. An internal combustion engine according to claim 20, wherein the base and a cover of the separator can be jointly or individually mounted on the mounting flange.

22. An internal combustion engine according to claim 20, wherein the drive chamber is located within the internal combustion engine under or behind the mounting flange.

23. An internal combustion engine according to claim 22, wherein a first bearing of the shaft is arranged in the base and a second bearing of the shaft is arranged in the drive chamber located in the internal combustion engine.

24. An internal combustion engine according to claim 23, wherein the second bearing of the shaft, arranged in the drive chamber located in the internal combustion engine, lies in the part with the seat extending into the drive chamber, the part being designed as part of the base.

25. An internal combustion engine according to claim 24, wherein the shaft is hollow over one part of its length and forms an oil channel, the pressurized lubrication oil is introducible via a rotary transmission into the oil channel, and the lubrication oil can be supplied to the at least one thrust nozzle, through the oil channel and through one branch channel each per thrust nozzle branching off from the oil channel and wherein an oil channel, forming the pressurized oil feed for the pressurized lubrication oil within the internal combustion engine, leads into the oil channel in the shaft on the second bearing.

26. An internal combustion engine according to claim 22, wherein a pressureless oil discharge channel is provided within the internal combustion engine, which discharges from the drive chamber the lubrication oil exiting from the at least one thrust nozzle.

27. An internal combustion engine according to claim 20, wherein the pressurized lubrication oil for the rotary drive of the centrifugal rotor is diverted from one clean side of a lubrication oil circulation of the internal combustion engine.

28. An internal combustion engine according to claim 20, wherein the pressurized lubrication oil for the rotary drive of the centrifugal rotor is diverted from one crude side of a lubrication oil circulation of the internal combustion engine.

29. An internal combustion engine with a separator according to claim 20, wherein the oil outlet is passed through the mounting flange into the internal combustion engine.

* * * * *